US009027178B2

(12) United States Patent
Wieland et al.

(10) Patent No.: US 9,027,178 B2
(45) Date of Patent: May 12, 2015

(54) SLEEP SYSTEM

(75) Inventors: Blair Wieland, Fort Wayne, IN (US); Steven Stieglitz, Harlan, IN (US); Anthony J. Warncke, Archbold, OH (US); Martin J. Krause, Jr., Fort Wayne, IN (US); Joel D. Alberda, Leo, IN (US); Donald E. Newfer, Auburn, IN (US)

(73) Assignee: Sauder Manufacturing Co., Archbold, OH (US)

( * ) Notice: Subject to any disclaimer, the term of this patent is extended or adjusted under 35 U.S.C. 154(b) by 229 days.

(21) Appl. No.: 13/168,438

(22) Filed: Jun. 24, 2011

(65) Prior Publication Data

US 2012/0131745 A1 May 31, 2012

Related U.S. Application Data

(60) Provisional application No. 61/358,699, filed on Jun. 25, 2010.

(51) Int. Cl.

| | |
|---|---|
| ***A47C 17/165*** | (2006.01) |
| ***A47C 7/50*** | (2006.01) |
| ***A47C 17/62*** | (2006.01) |
| *A47C 19/22* | (2006.01) |

(52) U.S. Cl.

CPC ..... *A47C 17/1655* (2013.01); *A47C 19/22* (2013.01); *A47C 7/506* (2013.01); *A47C 17/62* (2013.01)

(58) Field of Classification Search

CPC .... A47C 7/506; A47C 17/1655; A47C 17/62; A47C 19/22

USPC ..... 5/2.1, 3, 5, 7

See application file for complete search history.

(56) References Cited

U.S. PATENT DOCUMENTS

| | | | | | |
|---|---|---|---|---|---|
| 481,385 | A | * | 8/1892 | Barger | 5/2.1 |
| 2,028,426 | A | | 1/1936 | Wunderlich | |
| 2,295,083 | A | | 9/1942 | Jonassen | |
| 2,330,059 | A | | 9/1943 | Krakauer | |
| 2,435,936 | A | | 2/1948 | Wilson | |
| 2,437,949 | A | | 3/1948 | Fox | |
| 2,564,512 | A | * | 8/1951 | Specht | 5/2.1 |
| 2,634,429 | A | | 4/1953 | Hopeman | |
| 2,672,626 | A | | 3/1954 | Watt | |
| 2,714,729 | A | | 8/1955 | Bohnsack | |
| 2,028,105 | A | | 3/1960 | Bohnsack | |
| 3,048,855 | A | * | 8/1962 | Frank | 5/7 |
| 4,048,680 | A | | 9/1977 | Rogers | |
| 4,104,747 | A | | 8/1978 | Bell | |
| D321,797 | S | | 11/1991 | Paris | |
| D326,367 | S | | 5/1992 | Messina | |
| 5,224,228 | A | | 7/1993 | Larrimore | |
| 5,474,359 | A | * | 12/1995 | Muffi | 297/354.13 |
| 5,621,930 | A | * | 4/1997 | Reppas et al. | 5/136 |

(Continued)

*Primary Examiner* — Peter M Cuomo
*Assistant Examiner* — Brittany Wilson
(74) *Attorney, Agent, or Firm* — Varnum, Riddering, Schmidt & Howlett LLP

(57) ABSTRACT

A furniture system (400) includes a furniture back (408) having a back front surface (410). A desk (414) having an upper work surface (434) extends forwardly from an upper central portion of the front back surface (410). The system (400) also includes a pair of bases (426) with a pair of seats (424) positioned above the bases (426). A spatial interior area (427) exists between lateral sides of the seats (424), and the desk (414) is centered laterally between the seats (424). The furniture system (400) is movable between sitting configurations and sleeping configurations.

32 Claims, 31 Drawing Sheets

(56) References Cited

U.S. PATENT DOCUMENTS

| | | | | |
|---|---|---|---|---|
| 5,695,239 | A | 12/1997 | Johnson | |
| 6,508,526 | B2 * | 1/2003 | Reppas et al. | 312/237 |
| 6,651,274 | B2 | 11/2003 | Swihat | |
| 6,779,208 | B2 * | 8/2004 | Lim et al. | 5/136 |
| 6,904,628 | B2 | 6/2005 | Murphy | |
| 6,934,979 | B2 | 8/2005 | Swan | |
| D555,383 | S | 11/2007 | Borgonovo | |
| 7,549,182 | B2 | 6/2009 | Murphy | |
| 7,607,180 | B2 | 10/2009 | Griepentrog | |
| 2004/0195798 | A1 | 10/2004 | Newfer | |
| 2005/0267900 | A1 | 12/2005 | Ahmed | |
| 2007/0102975 | A1 * | 5/2007 | Gardner | 5/2.1 |
| 2007/0136952 | A1 | 6/2007 | Sargent | |
| 2008/0148478 | A1 | 6/2008 | Patella | |
| 2008/0189851 | A1 | 8/2008 | Griepentrog | |
| 2012/0131745 | A1 | 5/2012 | Wieland | |

* cited by examiner

SLEEP SYSTEM

CROSS-REFERENCE TO RELATED APPLICATIONS

This application claims priority of U.S. Provisional Patent Application Ser. No. 61/358,699, filed Jun. 25, 2010 and incorporated by reference herein.

STATEMENT REGARDING FEDERALLY SPONSORED RESEARCH OR DEVELOPMENT

Not applicable.

REFERENCE TO A MICROFISHE APPENDIX

Not applicable.

BACKGROUND OF THE INVENTION

1. Field of the Invention

The invention relates to furniture systems having the capability of converting between sofa and sleep surface configurations and, more particularly, furniture systems which may be adapted to healthcare environments for providing various environmental applications additional to sleeping and sitting, and providing such applications within a relatively small footprint.

2. Background Art

Various furniture systems are known in the prior art which include the capability of converting between differing types of furniture configurations. For example, it is known in the art to provide for the capability of converting a furniture system in the form of a sofa to one which provides for a bed or other sleep surface. However, many of the known systems have various disadvantages associated with their conversions between sofa and sleep surface configurations. A number of convertible furniture systems include components which are useful with respect to only one of the configurations. Some of these systems include "fold out" components which provide for bed surfaces when the furniture system is in a sleep surface configuration, but do not require the bed surface component for any useful purpose when the furniture system is in the sofa configuration.

Still further, a number of convertible furniture systems include back supports which are used when the furniture system is in a sofa configuration. However, when the known furniture systems are in a sleep surface configuration, the back support is retained in the same position as in the sofa configuration, and serves no useful purpose in the sleep surface configuration.

Also, it is not uncommon for known systems to require either forward or rearward movement of various furniture components when the known furniture system is moved from a sofa configuration to a sleep configuration. These forward and/or rearward movements can cause space difficulties with respect to placement of the furniture system. For example, forward encroachment of one or more of the furniture system components into a room can result in prevention of the furniture system being placed in a convenient location.

Still further, many of the known convertible furniture systems include relatively complex linkages for movement of various furniture components during conversion. The complexity of these linkages can result in substantial expense and are often relatively more subject to breakdown or damage. In addition, some linkages can present potential safety hazards. More specifically, complex linkages associated with known convertible furniture systems often include dangerous "pinch points" which can exist during linkage movement. Safety hazards associated with such linkage pinch points are exacerbated when the linkages are normally visible and physically accessible to children or others.

As an example of known convertible systems, Murphy, et al, U.S. Pat. No. 6,904,628 generally describes a sofa bed having a frame with opposing arms, and a seat. A subseat is hinged to the seat, and a connecting rod pivotably interconnects the subseat and the backrest. Pairs of center legs and end legs are pivotably attached to the subseat and seat, respectively. Mechanisms are provided for folding and unfolding the center and the end legs. The configuration includes a leg-folding mechanism which is pivotably interconnected with the center and the end legs. The frame, backrest, seat and subseat are configured so that the backrest, seat and subseat move from a folded position to an unfolded position. In the folded position, the backrest is generally upright, the seat is generally horizontal and the subseat is positioned beneath the seat in a first inverted orientation. In the unfolded position, the backrest, subseat and seat are generally horizontal, and the subseat is positioned between the backrest and the seat in a second non-inverted orientation. The leg-folding mechanism includes a center leg mechanism and an end leg mechanism. The center leg is pivotably interconnected with the subseat at a second pivot, with the second pivot being rearward of a first pivot when the sofa bed is in an unfolded position. The center leg mechanism includes a brace which is pivotably connected with the center leg and with the seat. The subseat and the seat are interconnected by means of a hinge. The hinge includes a subseat plate fixed to the subseat. The center leg is pivotably interconnected to the subseat plate at the second pivot.

Patella, U.S. Patent Application Publication No. 2008/0148478 describes a sofa bed having a base structure with a series of mutually hinged frames. The frames are supported by the base structure and support a series of padding elements. A kinematic mechanism is utilized to change the positions of the frames. The base structure includes a set of small legs, a spacer and a hinge plate consisting of two flat surfaces. The hinge plate is fixed on the small leg which consists of two flat surfaces with a rectangular hole. The hole is tapped on one side to lodge the spacer. An assembly procedure removes the clearance in the coupling between the hinge and the spacer, and obtains a perpendicular configuration between the spacer and the small leg.

Murphy, U.S. Pat. No. 7,549,182 discloses a seating unit having a frame and backrest section, with the backrest section having a cushion. Body, hinge and foot sections share a common cushion, and a folding mechanism includes a series of pivotably interconnected links which are configured so as to move the backrest, body, hinge and foot sections between folded and unfolded positions. In the unfolded position, the backrest, body, hinge and foot sections are horizontally disposed and serially aligned. The backrest cushion and the common cushion face upwardly. In the folded position, the backrest section is upright, with the backrest cushion facing forwardly. The body section is horizontally disposed, and the foot section overlies the body section. The hinge section is vertically disposed and extends between the body and foot sections. The common cushion is folded upon itself. A portion of the common cushion overlying the body section and a portion of the common cushion underlying the foot section are compressed against each other. In addition, the body, hinge and foot sections each include a panel. A fixed support hinge includes a flexible sheet member which is fixed to the body and hinge section panels. A second support hinge which includes a flexible sheet member is fixed to the hinge and foot section panels.

In addition to providing for a furniture system having the capability of converting between sofa (or sitting) and sleep configurations, it would also be advantageous to provide a furniture system for providing other functional applications within its own structural framework. For example, hospitals were previously constructed with patient rooms having two, four or even more beds. Spatial requirements would often be somewhat of an issue, although the costs of building space were substantially lower in the past, relative to today's building space costs. Today, hospitals are almost universally moving to single occupancy rooms. Whether in single or multiple-occupancy rooms, all such rooms much provide appropriate space so that the normal functions associated with the patients' rest, recovery and care are achieved safely and within an efficient space.

Still further, and in accordance with today's knowledge regarding patients after-care and recovery following illnesses, operations and the like, it is important to promote social interaction between patients and their families and friends. In this regard, it is advantageous to provide a spatial environment within patient rooms which is comfortable for visiting family members and friends. In fact, it is particularly advantageous if the patient rooms can essentially serve as a "family room" for all those who come to visit and care for the ailing patient. However, for efficiency and in view of building costs, today's single occupancy rooms tend to be relatively smaller in size than patient rooms constructed in the past. Further, however, notwithstanding that the patient rooms may be smaller, efficiency and safety require careful room planning and strict adherence to "clearance" requirements for patients and medical staff. That is, all of the furniture associated with the patient room must provide for safe and "quick" passage around the furniture, not only for persons, but also for movement of equipment and the like.

As earlier mentioned, hospitals recognize the relatively high value of including family members and close friends fully in the patient recovery process. To achieve this inclusion, hospitals much "embrace" the family and their needs in new and imaginative ways in these newer single occupancy and smaller footprint rooms. Such imagination requires creativity in furniture design beyond the conventional. For example, it is relatively well known and clear that it is advantageous to provide visiting family and friends with comfortable places to sit. However, beyond the need for such furniture, family and friends often also need a place to "desk." That is, it would be advantageous for the family and friends to have efficient means and structure to use a laptop, write letters, place phone calls and use other electronic devices. In addition, desking provides for the capability of comfortably eating meals, or otherwise just having a place to put personal items (such as a purse) or various decorations (vases of flowers, etc.).

In addition to the foregoing, the healthcare industry has also recognized that encouraging overnight stays of family members both facilitates patient recovery, and also can aid in providing staff with a measure of relief. Accordingly, it would be advantageous if furniture systems used in the single occupancy rooms could also include sleep surfaces. With respect to all of the foregoing, there are presently few, if any, comprehensive solutions for this combination of structural and functional needs to be met within today's hospital facilities.

SUMMARY OF THE INVENTION

In accordance with the invention, an efficient and comfortable seating unit is incorporated within a furniture system which may be adapted for use in hospital patient rooms or other building structures where it is advantageous to provide a number of environmental functions, within relatively small footprints. In this regard, the invention includes a seating unit as a foundation, to which structure has been added which provides for desking and sleeping in one furniture unit having relatively efficient spatial requirements. The furniture system essentially acts as a virtual "family unit" within a confined space, such as a hospital patient room. In accordance with certain aspects of the invention, the furniture system requires a relatively small and compact footprint which does not encroach on "working space" of a hospital room. Accordingly, medical staff can readily move about the hospital room, even in emergency situations, while family members can still remain in the room in a manner where they are not interfering with staff movement. The furniture system in accordance with the invention includes convenient seating, while also providing for working space. Still further, in accordance with certain aspects of the invention, the furniture system can be readily converted from a seating position to a sleeping configuration.

In accordance with various other aspects of the invention, the system can provide for integrated seating, work surface/desking, and sleeping configurations. Still further, in accordance with other aspects of the invention, the furniture system can include integrated footrests and integrated storage areas. In accordance with certain other advantages of the invention, the conversion from a seating position to a sleep configuration can occur within the structure's own footprint. In accordance with other aspects of the invention, the sleep surface can be separate from the seating surface. Still further, the conversion mechanisms for configuring and reconfiguring the furniture system can be concealed, such as within arms of the furniture system. The seating configurations can include multiple positions, such as forward and sideways positions. Still further, the work surface or desk associated with the furniture system in accordance with the invention can be converted, without the necessity of moving the work surface or desk out into the patient room.

In accordance with certain aspects of the invention, the sleep system assembly is convertible between various environmental applications. The assembly includes a supporting frame with a seat having an upper surface on which a user may sit when the assembly is in a sofa or sitting configuration. At least one linkage mechanism is provided, with the linkage mechanism directly or indirectly connected to the frame, and adapted to move the sleep system assembly between the sofa configuration and others of the environmental applications. A desk is positioned forwardly and extends in a horizontal plane when the sleep system assembly is in the sitting configuration.

In accordance with other aspects of the invention, the environmental applications include at least the sitting configuration, a sleeping configuration and a desking configuration. A footprint of the assembly is maintained as a predetermined footprint independent of the particular environmental application of the assembly at any given time. A back support is provided within the sofa configuration. The linkage mechanism is hidden from view at all times during operation and stationary position of the assembly.

The assembly is specifically adaptable between the sleep configuration and a desking application, and is also convertible between the sleep configuration and sitting configuration, and the sitting configuration and the desking application. The work surface can be coupled to a back front surface. The work surface moves in unison with the back front surface when the assembly is moving between configurations. When the assembly is in the sleep configuration, the work surface is in a vertically oriented configuration. The work surface can be converted between an operable position and a non-operable position, without the necessity of moving outside of a footprint of the sleep system assembly when in either of the positions.

The work surface is positioned so as to not extend forwardly beyond a front vertical plane of the entirety of the assembly. The work surface is capable of being stored between opposing seats of the assembly when the assembly is in the sleep configuration. In the sleep configuration, the work surface is fitted within opposing seats of the assembly.

When the assembly is in the sitting configuration, the assembly comprises pairs of bases and seats, configured so as to provide a spatial interior area between lateral sides of the seats and bases, with the seats and bases facing each other. When in this configuration, and users are seated on the seats, the users can position their legs forwardly of a front vertical plane of the assembly or, alternatively, can position their legs in a sideways orientation, with their legs extending into the interior spatial area.

In accordance with other aspects of the invention, the assembly comprises at least one integrated storage area. The assembly can also comprise at least one integrated footrest, with lever means for manipulating the footrest. Further, the work surface can be centered laterally between seats of the assembly, with a width which is smaller than the width of the spatial interior area.

BRIEF DESCRIPTION OF THE SEVERAL VIEWS OF THE DRAWING

The invention will now be described with reference to the drawings, in which.

DETAILED DESCRIPTION OF THE INVENTION

The principles of the invention are disclosed, by way of example, with respect to a series of embodiments of furniture systems in accordance with the invention, as described herein and illustrated in FIGS. 31-54. Furniture systems in accordance with the invention have the capability of converting what is characterized as a "sofa" or "seat" or "sitting" configuration, to a "bed" or "sleep surface" or "sleep" configuration. Although example embodiments of linkage mechanisms are disclosed herein for purposes of converting the furniture systems between the configurations, it should be emphasized that furniture systems in accordance with various principles of the invention are not limited to any specific type of linkage mechanism. That is, various linkage mechanisms can be utilized without departing from the primary novel concepts of the invention. The furniture systems in accordance with the invention provide a highly efficient and compact seating unit as a foundation, and that includes the combination and addition of structures to meet the needs of "desking" and sleeping into a single space-efficient furniture unit. With such a unit, a virtual "family room" can be provided within a confined space, such as a hospital patient room. In addition, furniture systems in accordance with certain aspects of the invention, and as disclosed in the embodiments herein, can include integrated footrest and storage facilities, as well as multiple seating positions. Further, the desking or work surface areas can be positioned in functional configurations, without such work surfaces extending outwardly from the basic footprint of the furniture system. These and other aspects of the invention will be made apparent from the furniture systems embodied within FIGS. 31-54 and described in the following paragraphs.

For purposes of providing a full and detailed description of furniture systems in accordance with the invention as illustrated in FIGS. 31-54, example furniture systems utilizing linkage mechanisms to convert the systems between sofa and sleep configurations are described herein and illustrated in FIGS. 1-30. These systems illustrated in FIGS. 1-30 and described herein were previously described in a commonly owned provisional patent application titled "SLEEP SYSTEM MECHANISM" filed Dec. 14, 2009, and identified as U.S. Provisional Patent Application Ser. No. 61/286,285.

Figure 1:
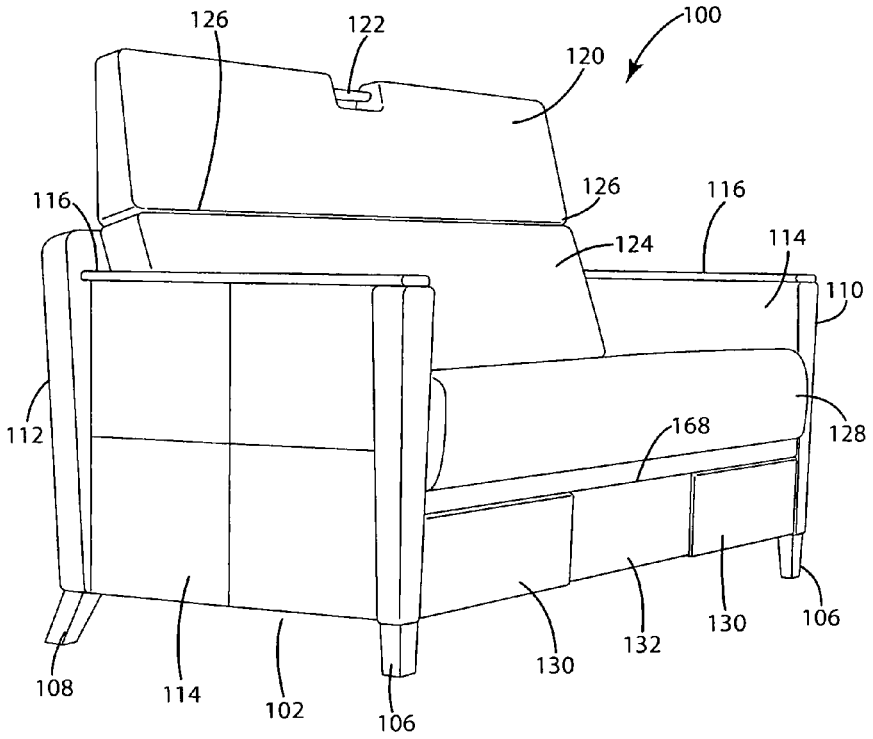
FIG. 1 is a left-side perspective view of a first embodiment of a furniture system, with the furniture system illustrated in a sofa configuration, and having one or more retracted ottomans and a retracted drawer.
Figure 2:
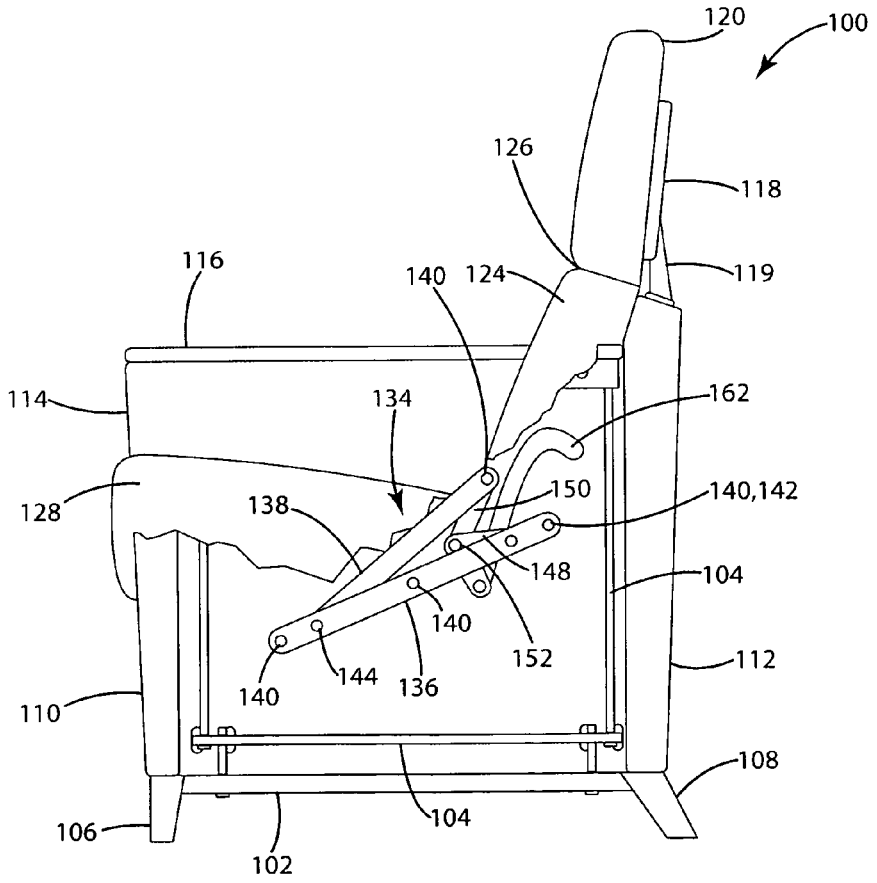
FIG. 2 is a right-side elevation view of the first embodiment of the furniture system shown in FIG. 1, and showing a portion of the right-side of the furniture system cut away so as to illustrate one of the sleep system linkage mechanisms used with the furniture system.
Figure 3:
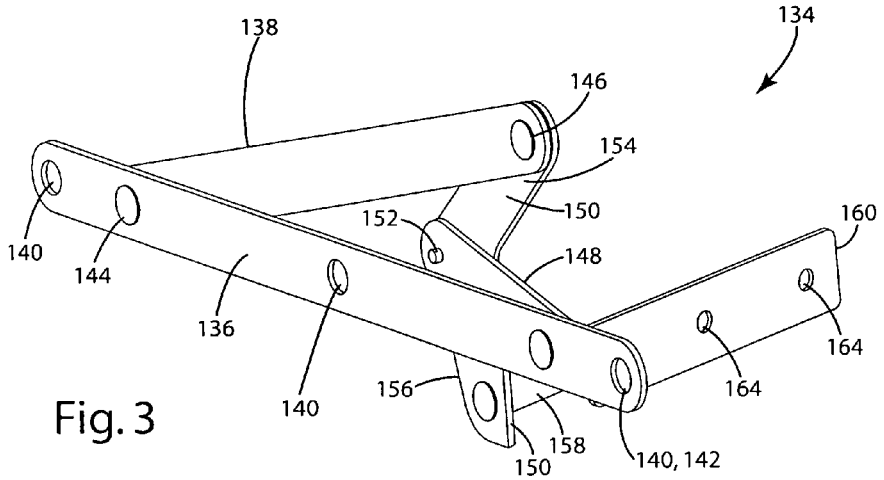
FIG. 3 is a forward, perspective view of the sleep system linkage mechanism illustrated in FIG. 2.
Figure 4:
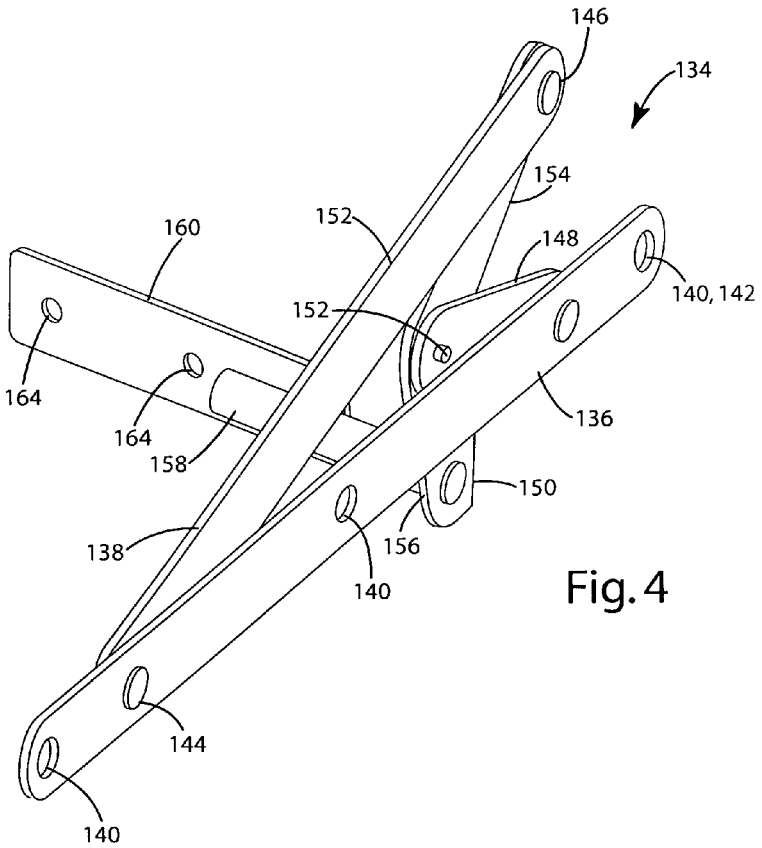
FIG. 4 is a perspective view of the linkage mechanism shown in FIG. 3, rotated 90 degrees in a horizontal plane relative to FIG. 3.
Figure 5:
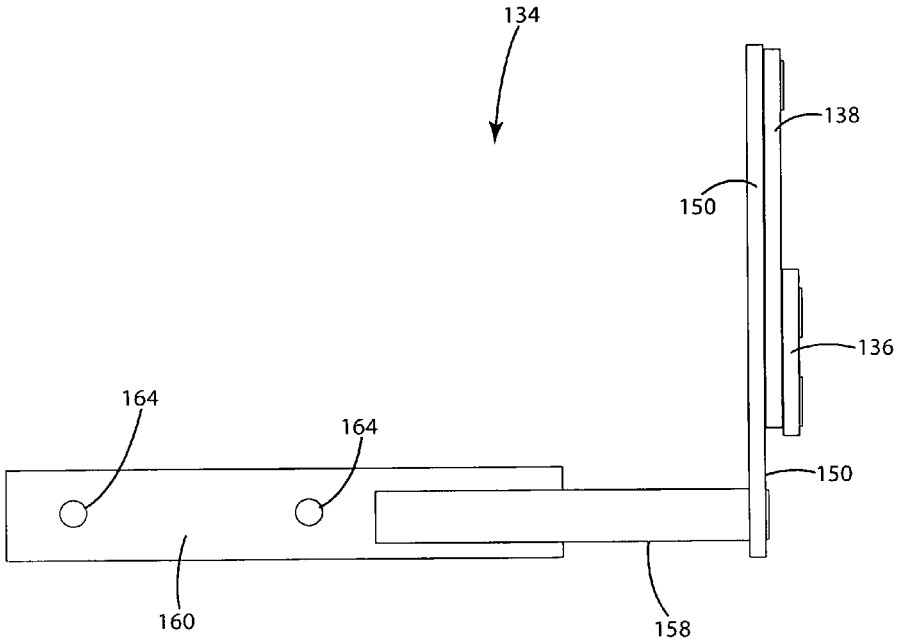
FIG. 5 is a front, elevation view of the linkage mechanism shown in FIG. 4.
Figure 6:
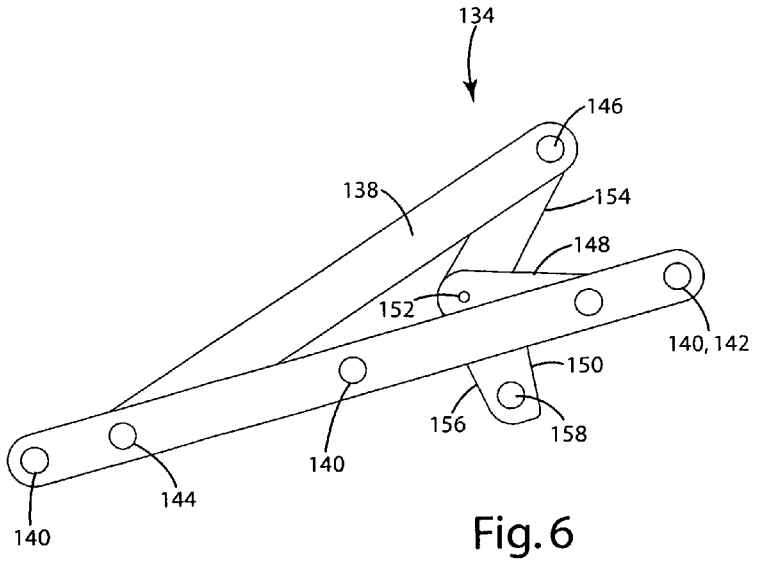
FIG. 6 is a side, elevation view of the linkage mechanism shown in FIG. 5, and illustrating the mechanism in a configuration corresponding to the furniture system being in a sofa configuration.
Figure 7:
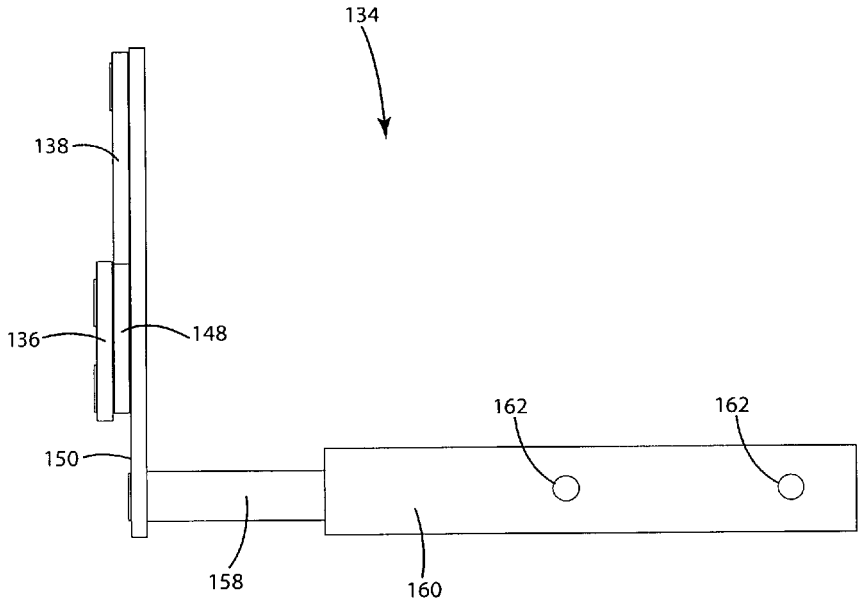
FIG. 7 is a rear, elevation view of the linkage mechanism shown in FIG. 6.
Figure 8:
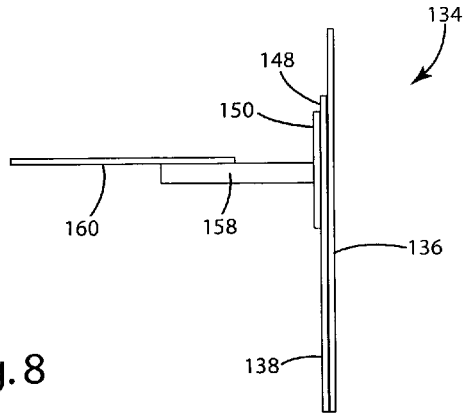
FIG. 8 is a view which can be characterized as a plan view of the linkage mechanism shown in FIG. 7.

Turning first to FIGS. 1 and 2, FIG. 1 illustrates the furniture system 100 in a left-side perspective view. In FIG. 1, the system 100 is shown in the "sofa" configuration. Correspondingly, FIG. 2 is a side, elevation and partially "cut away" view of the furniture system 100 shown in FIG. 1, again with the system in a sofa configuration. As shown in these illustrations, the furniture system 100 can include a lower base 102 having any of a number of various configurations. The lower base 102 is connected to other structural components through a connecting frame 104. The base 102 and connecting frame 104 can be structured in any of a number of various configurations. Integral with or otherwise secured to the lower base 102 are a series of front legs 106 and rear legs 108 (only one of the rear legs 108 being shown in FIGS. 1 and 2). Upstanding adjacent the front legs 106 are a pair of front corners 110. Located at the rear of the furniture system 100 and extending upwardly from the rear legs 108 is a stationary furniture back 112. Secured to the front of the stationary furniture back 112 adjacent the lateral edges thereof are a pair of sides 114. The sides 114 extend forwardly and can include corresponding arms or armrests 116 positioned on the top of the sides 114.

For purposes of strength and support, the furniture system 100 can also include a stationary high back support 118 extending upwardly from the stationary furniture back 112. The stationary high back support 118 can be positioned above the stationary furniture back 112 and secured through the use of a pair of support mounts 119. The overall shape and structural configuration of the stationary high back support 118, support mounts 119, and stationary furniture back 112 are best illustrated in drawings which show furniture system embodiments in a sleep or bed configuration, such as FIG. 16.

As further shown in FIGS. 1 and 2, the furniture system 100 also includes a movable high back cushion 120. The movable high back cushion 120, with the system 100 in a sofa configuration, can rest against the stationary high back support 118 as expressly shown in FIG. 2. The movable high back cushion 120 can include a handle 122 accessible to the user. As described subsequently herein, a user can be positioned in the front of the furniture system 100 and can pull forwardly on the handle 122 so as to initiate movement of the system 100 from a sofa configuration to a sleep or bed configuration. Coupled to the movable high back cushion 120 at the lower portion thereof is an intermediate back cushion 124. As shown in the drawings, the intermediate back cushion 124 can be somewhat angled relative to vertical when the system 100 is in the sofa configuration. Coupling between the movable back cushion 120 and the intermediate back cushion 124 can be provided through the use of a fabric hinge 126. The fabric hinge 126 can be configured so as to secure together the back cushion 120 and back cushion 124, while allowing some relative movement therebetween when the furniture system 100 is moved from the sofa configuration to the sleep or bed configuration. In addition to the foregoing components, the furniture system 100 also includes a seat cushion 128, shown in both FIGS. 1 and 2. As will be apparent from further description herein, the seat cushion 128 remains stationary during conversion movement of the furniture system 100 between the sofa configuration and the bed or sleep surface configuration.

In addition to the foregoing components of the furniture system 100, the system 100 can include one or a pair of extendible and retractable integrated ottomans 130. The ottomans 130 are shown in a retracted configuration in FIG. 1, and are positioned below the seat cushion 128 on opposing sides of the system 100. The ottomans 130 will be subsequently described herein, primarily with respect to FIGS. 25, 26 and 27. In addition to the ottomans 130, the furniture system 100 can also include an extendible and retractable drawer 132. As shown in FIG. 1, the drawer 132 can be located below the seat cushion 128 and intermediate the ottomans 130. FIG. 1 illustrates the drawer 132 in a retracted position.

The furniture system 100 can also include a pair of linkage mechanisms 134. FIG. 2 illustrates one of the linkage mechanisms 130. The structure and functional operation of the linkage mechanisms 134 will be described in subsequent paragraphs herein with respect to FIGS. 2-14. The drawings illustrate only one of the linkage mechanisms 134, and the subsequent description herein will primarily be directed only to a single linkage mechanism 134. However, both of the linkage mechanisms 134 will operate in tandem and are structurally and functionally equivalent.

Each of the linkage mechanisms 134 is configured and packaged so as to exist within the interiors of each of the sides 114 below the arms 116. Positioning the linkage mechanisms 134 in these "hidden" interiors essentially eliminates a safety hazard which exists with respect to other linkage systems which may have physically accessible "pinch points" and other structures of potential harm.

Turning to the details of the example embodiment of the linkage mechanisms 134, reference is first made to FIGS. 2-10. FIG. 2, as earlier described, illustrates one of the linkage mechanisms 134 as coupled to the furniture system 100 and secured within one of the sides 114. FIGS. 3-10 illustrate the linkage mechanism 134 in a "stand alone" configuration, with each of the illustrations showing the linkage mechanism 134 in various orientations. In each orientation, the linkage mechanism 134 is illustrated in the configuration shown in FIG. 2, which corresponds to the furniture system 100 being in a sofa configuration. The linkage mechanism 134 includes a mechanism base plate 136 having an elongated configuration as illustrated in each of FIGS. 2-10. The mechanism base plate 136 essentially remains stationary during functional operation of the linkage mechanism 134 as the furniture system 100 moves between the sofa position and the sleep or bed position. The mechanism base plate 136 is fixedly secured to the inner portion of a corresponding side 114 at frame connection points 140. As shown initially in FIG. 2, the mechanism base plate 136 includes three frame connections points 140. The connection points are essentially located at the ends of the base plate 136 and one connection point 140 is located adjacent the center area of base plate 136. For purposes of having the base plate 136 "stand away" from the side 114, the base plate 136 can be secured to the furniture system side 114 at the frame connection points 140 through a series of three plastic spacer bushings having flat head bolts (and associated T-nuts) inserted therethrough. As an example of sizing, the plastic spacer bushings can be 0.80 inches thick, with the bolts each being 5/16 inches in size. In addition to the foregoing, the plastic spacer bushing which is associated with the frame connection point 140 located at one end of the base plate 136 is identified not only with a numerical reference 140, but with numerical reference 142. The plastic spacer associated with this particular connection points 140, 142 will function as a stop for the linkage 148 (shown in FIG. 14) when the furniture system 100 is moved to a sleep position. It should be noted that FIG. 2 is illustrating the system 100 in the sofa position.

In addition to the mechanism base plate 136, the linkage mechanism 134 also includes a primary mechanism lever 138 having an elongated configuration as also shown in FIGS. 2-10. Front and rear views of the primary mechanism lever 138 can best be seen in FIGS. 6 and 9. The primary mechanism lever 138 has an elongated configuration and is pivotably coupled to the mechanism base plate 136 at a mechanism hinge point 144. The primary mechanism lever 138 can be characterized as one of two moving levers which govern the path of the intermediate back cushion 124 during movement in converting between sofa and bed or sleep surface configurations. With the primary mechanism lever 138 pivotably coupled at one end to the mechanism base plate 136 at mechanism hinge point 144, the opposing terminating end includes a pivot connection referenced as the main hinge point 146. The primary mechanism lever 138 can be characterized as linking this main hinge point 146 to the sofa frame or side 114 through the mechanism base plate 136.

Figure 9:
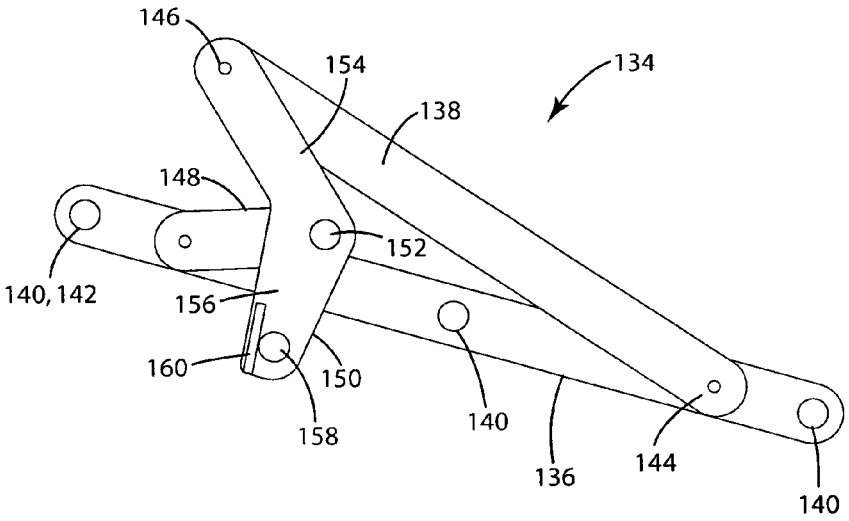
FIG. 9 is a side, elevation view of the linkage mechanism shown in FIG. 8, with the view directly opposing the side, elevation view of the linkage mechanism shown in FIG. 6.
Figure 10:
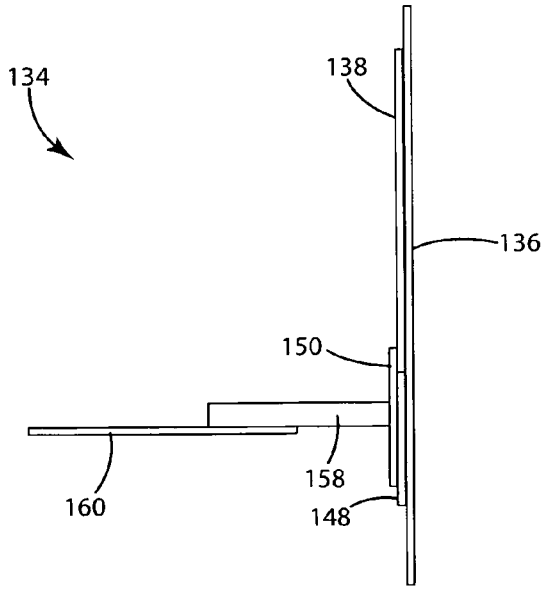
FIG. 10 is an underside view of the linkage mechanism shown in FIG. 9.

The linkage mechanism 134 further includes a secondary mechanism lever 148, again primarily shown in FIGS. 2-10. The secondary mechanism lever 148, as described subsequently herein, controls the rotational arc of the back cushions 120, 124 as they move between sofa and bed configurations. The secondary mechanism lever 148 is connected to the primary mechanism lever 138 at the main hinge point 146 through what is characterized as a mechanism control link 150. The mechanism control link 150 can be characterized as being locked into position relative to the back cushion 124. That is, the relative orientations of the link 150 and back cushion 124 remain the same during movement. The secondary mechanism lever 148 is hinged to the mechanism control link 150 at the hinge point 152 illustrated in the drawings. The mechanism control link 150 is particularly shown in its entirety in FIG. 9, and includes a first section 154 and an integral second section 156 which is angled relative to the first section as shown in FIG. 9. Also shown in FIG. 9 is the hinge point 152. The hinge point 152 is the pivotal connection between the mechanism control link 150 and the secondary mechanism lever 148. As further shown primarily in FIGS. 3-10, the linkage mechanism 134 also includes a mechanism drive shaft 158. The mechanism drive shaft 158 has a cylindrical and elongated configuration. One end of the mechanism drive shaft 158 is secured to one end of the second angled section 156 of the mechanism control link 150. The drive shaft 158 can be press fitted or otherwise secured to the mechanism control link 150 in any suitable manner. As further shown in a number of the drawings, including FIG. 3, a mechanism connection plate 160 is fixedly secured to an outer surface of the mechanism drive shaft 158. The mechanism connection plate 160 can be rectangular in configuration, with its elongated dimension running axially along the outer surface of the mechanism drive shaft 158. The connection plate 160 can be secured to the drive shaft 158 by any suitable means, including weldments and the like.

With reference back to FIG. 2, the inner portion of the side 114 shown therein includes a cut out portion in the form of a curvilinear clearance slot 162. The clearance slot 162 acts so as to provide for what could be characterized as minimum clearance for other components so as to avoid the occurrence of any pinch points associated with the sleep mechanism. To provide for a connection between moving components of the linkage mechanism 134 and the bed cushions 120, 124 of the furniture system 100, the connection plate 160 can be appropriately secured to these components of the system 100. As shown for example in FIG. 3, apertures 164 are formed through the connection plate 160 so as to provide the capability of securing the connection plate 160 to other components of the furniture system 100 through screws or other suitable connecting means. For example, the connection plate 160 can be secured through the use of 5/16 inch buttonhead bolts, with corresponding T-nuts.

Figure 11:
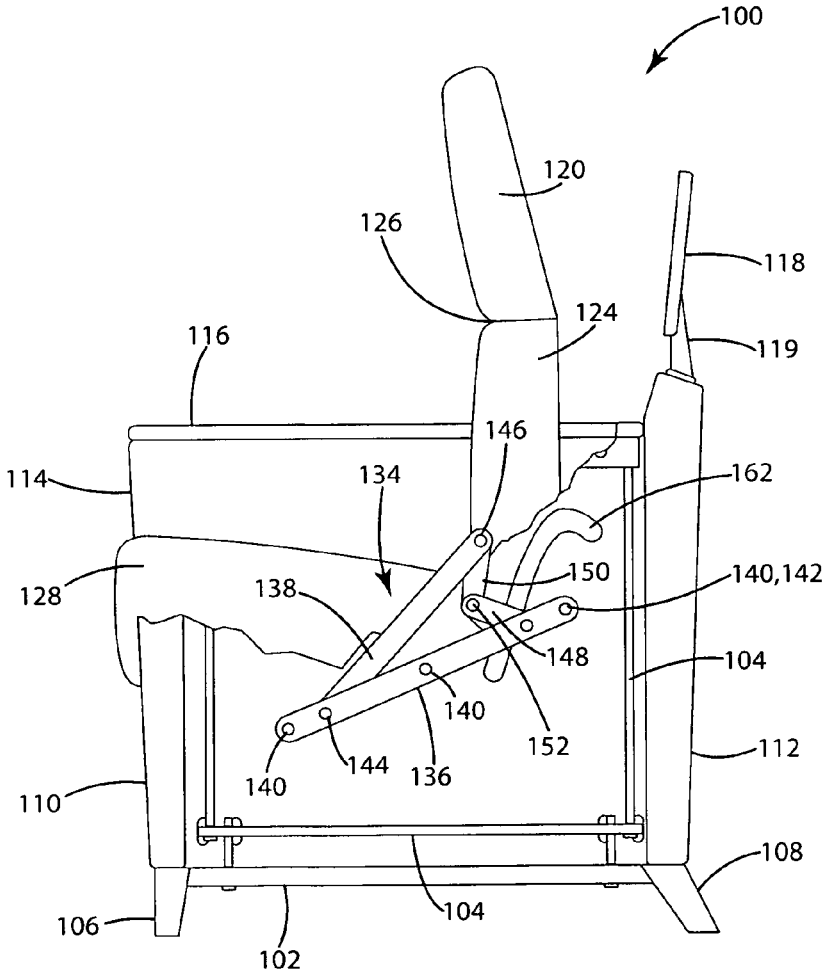
FIG. 11 is a side, elevation view of the furniture system shown in FIG. 2, with one of the linkage mechanisms shown within a cutout configuration, with the illustration similar to FIG. 2 but showing the furniture system and linkage mechanism in an "intermediate" position as the furniture system is moved between the sofa configuration and the bed or sleep surface configuration.
Figure 12:
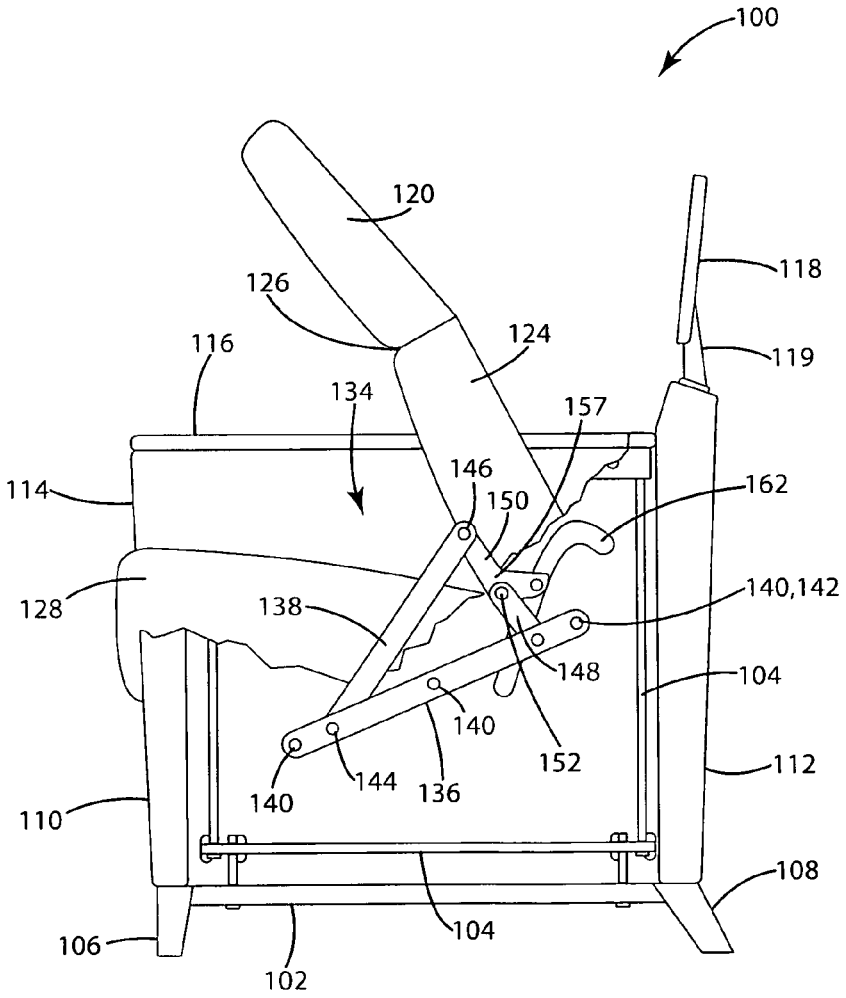
FIG. 12 is a side, elevation view of the furniture system shown in FIGS. 2 and 11, with one of the linkage mechanisms shown in a cutout configuration, and showing the furniture system, relative to FIG. 11, in a further transient position as the system is converted from the sofa configuration to the bed or sleep surface configuration.
Figure 13:
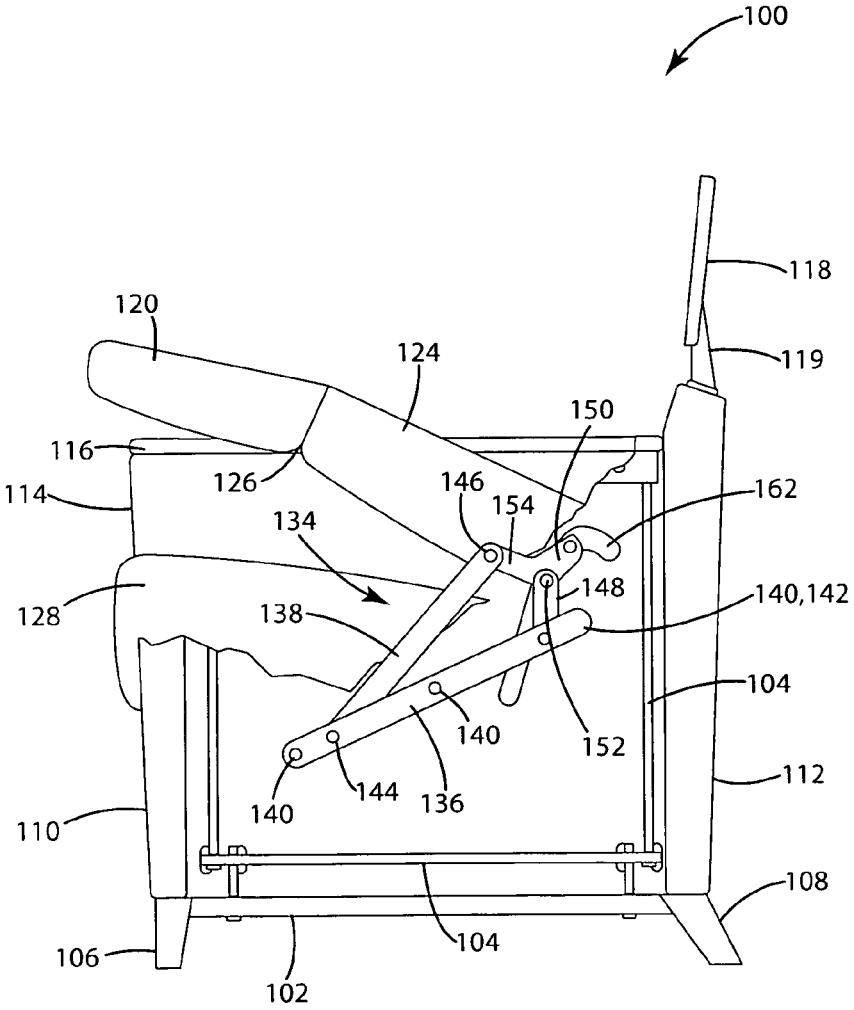
FIG. 13 is a side, elevation view of the furniture system shown in FIG. 12, and showing the system in further movement toward a bed or sleep surface configuration, with the back cushions moving further rearwardly.

Operation of the furniture system 100 with the linkage mechanisms 134 will now be described primarily with respect to FIGS. 2 and 11-14. FIG. 2, as previously described, illustrates the furniture system 100 in a sofa configuration. In this configuration, the user can pull forward on the top of high movable back cushion 120 through the handle 122 (the handle 122 is illustrated in FIG. 1). With the primary mechanism lever 138 linking the main hinge point 146 to the frame of the furniture system 100, the pulling forces exerted on the high movable bed cushion 120 will cause the main hinge point 146 to move upwardly and forwardly. This movement is particularly shown in FIGS. 11, 12 and 13. As specifically shown therein, this movement of the main hinge point 146 upwardly and forwardly permits the back cushions 120, 124 to also move upwardly and rotate forwardly in a manner so as to "clear" the seat cushion 128. Further, with this rotational arc of the back cushions 120, 124, the intermediate back cushion 124 is permitted to clear the seat cushion 128 without interfering with the stationary furniture back 112. FIGS. 12 and 13, in particular, show the back cushion 124 clearing the seat cushion 128, with corresponding clearance of the stationary furniture back 112. More specifically, the secondary mechanism lever 148, as earlier mentioned, controls the rotational arc of the back cushion 124. As illustrated in part in FIG. 2, with the furniture system 100 in the sofa configuration, the secondary mechanism lever 148 is in a substantially horizontal plane. During movement as illustrated in FIGS. 11, 12 and 13, the rotational arc of the secondary mechanism lever 148 and the back cushion 124 is initially upward. This upward movement provides for the requisite lift so as to clear the seat cushion 128.

As rotation of the back cushion 124 continues, the cushion will reach a position as particularly shown in FIG. 13. Further rotation will thereafter cause the back cushion 124 to essentially move rearwardly, with the primary mechanism lever 138 correspondingly moving downwardly. This movement will continue until the elongated primary mechanism lever 138 contacts the mechanism stop 142. With appropriate sizing and structural configuration of the various components of the linkage mechanisms 134, stoppage of the movement of the primary mechanism lever 138 will occur when the back cushions 120, 124 are essentially in a substantially planar configuration, as particularly shown in FIG. 14. This configuration corresponds to the bed or sleep surface configuration for the furniture system 100.

Figure 14:
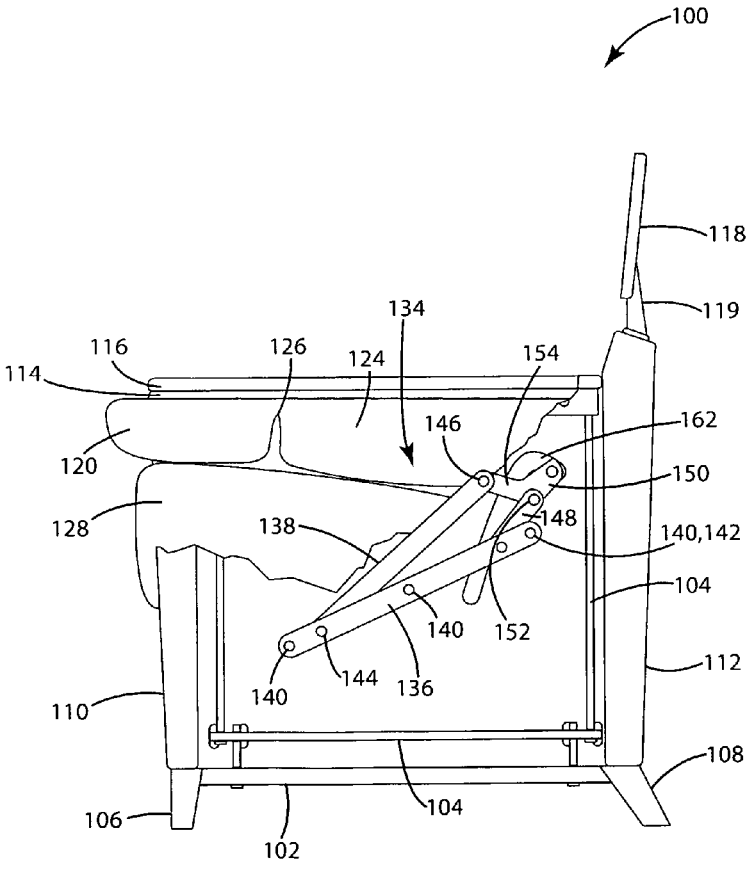
FIG. 14 is a side, elevation view of the furniture system shown in FIG. 13, and showing the furniture system in a final bed or sleep surface configuration, and further showing the position of the primary mechanism lever as it contacts a stop.

More specifically, the high movable back cushion 120 provides not only seating comfort when in the sofa configuration, but also provides a relatively large sleep surface when in the sleep or bed configuration. This occurs in substantial part because the particular motion of the system mechanism allows the lower "hidden" portion of the back to be pulled out from behind the seat cushion, and to therefore be utilized as part of a sleep surface. Also, in this bed or sleep configuration as shown in FIG. 14, the fabric hinge 126 has allowed a gap or a spacing 166 to be formed between the high movable back cushion 120 and the intermediate back cushion 124. This capability of exhibiting this spacing 166 provided by the fabric hinge 126 permits the back of the high movable back cushion 120 and the back of the intermediate back cushion 124 to locate in the same, level horizontal plane. The fabric hinge 126 allows this horizontal plane configuration to be achieved, while also allowing a somewhat angular orientation to exist between the cushions 120, 124 when the furniture system 100 is in the sofa position as shown in FIG. 2. In general, the fabric hinge 126 permits articulation of the back cushions 120, 124. Further, the interface between the height and angle of the seat cushion, and the front sides of the two back cushions, also plays a role in achieving the advantageous horizontal, planar sleep surface.

Further, when the furniture system is in the bed or sleep position as shown in FIG. 14, the secondary mechanism lever 148 can essentially be characterized as being oriented beyond center. With this configuration, the secondary mechanism lever 148 will essentially support the sleep surface formed by the back cushions 120, 124, with the back cushion 124 located in part within the area which overhangs the seat cushion 128. That is, downwardly directed forces exerted on the back cushion 124 within this area which overhangs the seat cushion 128 will essentially be translated to the mechanism 142 through the primary mechanism lever 138 and the coupling to the secondary mechanism lever 148. Movement will essentially be stopped when the secondary mechanism lever 148 abuts the spacer associated with the frame connection point 142, which essentially acts as a third attachment for the mechanism base plate 136.

As earlier mentioned, the linkage mechanisms 134 can be confined within the sides 114 of the system 100. Accordingly, there is an aesthetically favorable "clean" look to the sides of the system 100, with no linkage mechanisms 134 being visible. Also, the linkage mechanisms 134 do not exhibit any physically accessible or visual pinch points which can present a safety hazard. In this regard, the clearance slot 162 is hidden from view by the back and sufficient distance is provided between the slot 162 and the mechanism drive shaft 158 and mechanism connection plate 160 so as to avoid any pinch points which may be associated therewith. Further, with the linkage mechanisms 134, movement between sofa and sleep configurations is highly controlled, relatively error-proof, and requires only a "simple" path of motion. It should be emphasized that the reference to the "simple" or "single" path of motion refers to the required motion of the user. That is, to operate the furniture system 100, the user does not have to exert forces in multiple directions, take multiple stances or otherwise require any complex body movements. In this regard, the operational activities required by the user are essentially of minimal effort and can also be characterized as being "intuitive" for activities associated with converting an apparatus between a sofa position and a bed position.

With the system 100 as described herein, areas which can be characterized as "cleanouts" are provided at interfaces between the seat cushion 128 and the intermediate back cushion 124. These cleanout spaces also exist between the movable back cushions 120, 124 and the stationary furniture back 112. The formation of these spatial areas provides for allotted space for dirt and the like to fall (or to be pushed through) directly to a floor surface below the furniture system 100. This is a feature which can be particularly advantageous in settings such as health care facilities and areas of public access.

As previously described, the system 100 is shown in FIG. 1 with a pair of extendible and retractable ottomans 130 positioned on opposing sides of the front of the lower portion of the furniture system 100. The ottomans 130 are shown in FIG. 1 in a retracted position. In addition, a drawer can also be incorporated within the furniture system 100, such as the extendible and retractable drawer 132 positioned intermediate the ottomans 130. In FIG. 1, the drawer 132 is also shown in a retracted position. The drawer 132 includes a handle 168 for purposes of extending and retracting the drawer 132. For purposes of operating the ottomans 130, so as to move the same between its extended and retracted positions, manually operable actuator levers 170 can be located on the outer surfaces of the opposing sides 114 of the furniture system 100 (only one of these levers 170 being shown in FIG. 1). One of the levers 170 can be utilized to functionally operate the ottoman 130 closest to the lever 170. The mechanisms for linking levers such as levers 170 to extendible and retractable ottomans are relatively well known in the art. Any of a number of different connection mechanisms can be utilized to provide for the appropriate structure and functional operation.

Figure 15:
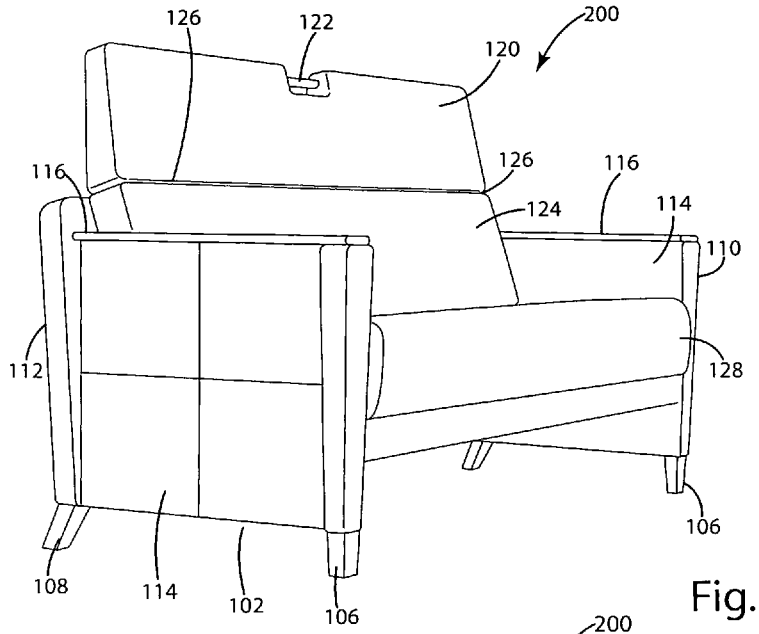
FIG. 15 is a left-side perspective view of a further embodiment of a furniture system in accordance with the invention, and showing the system in a sofa configuration, with recessed wood cap arms and an open base.
Figure 16:
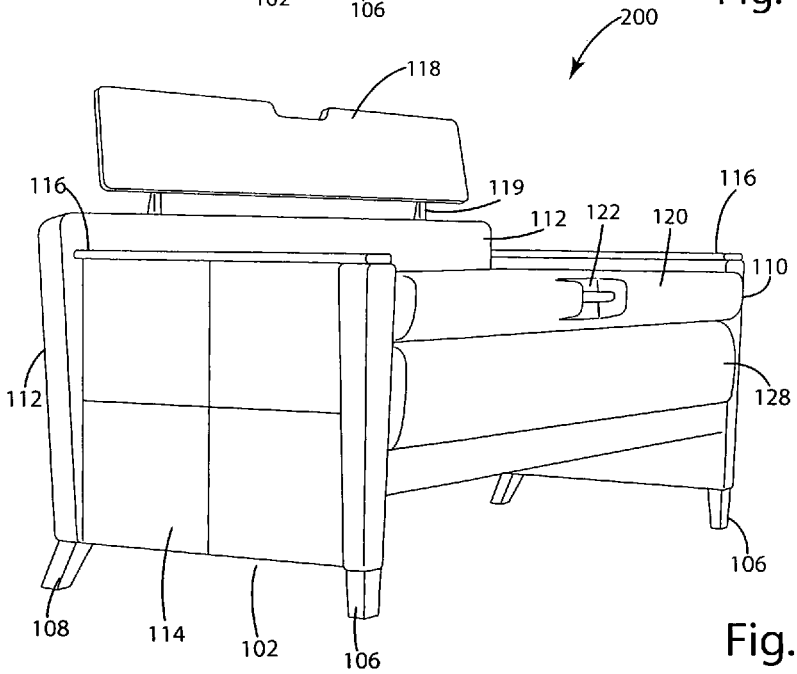
FIG. 16 is a left-side perspective view of the furniture system shown in FIG. 15, but showing the high back support and the furniture system in a sleep configuration.
Figure 17:
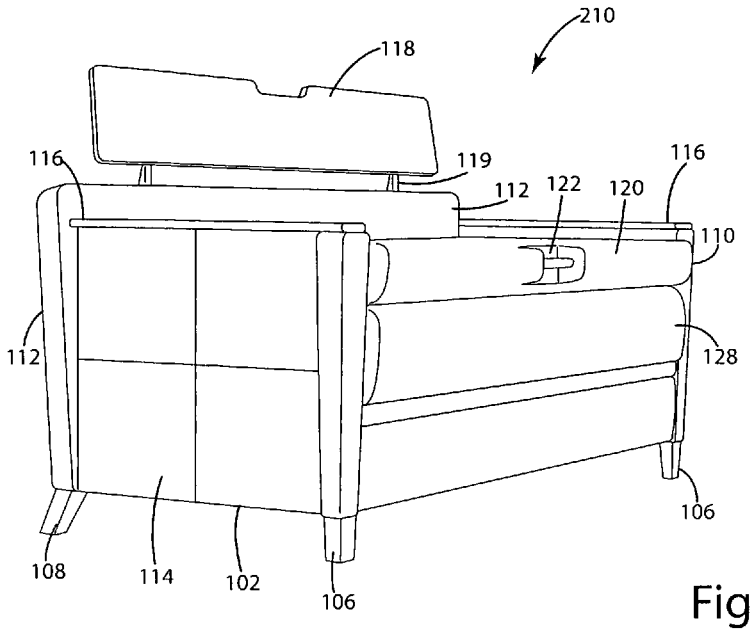
FIG. 17 is a left-side perspective view of a further embodiment of a furniture system in accordance with the invention, showing the system in a sleep position and having recessed wood cap arms with a continuous upholstered panel.
Figure 18:
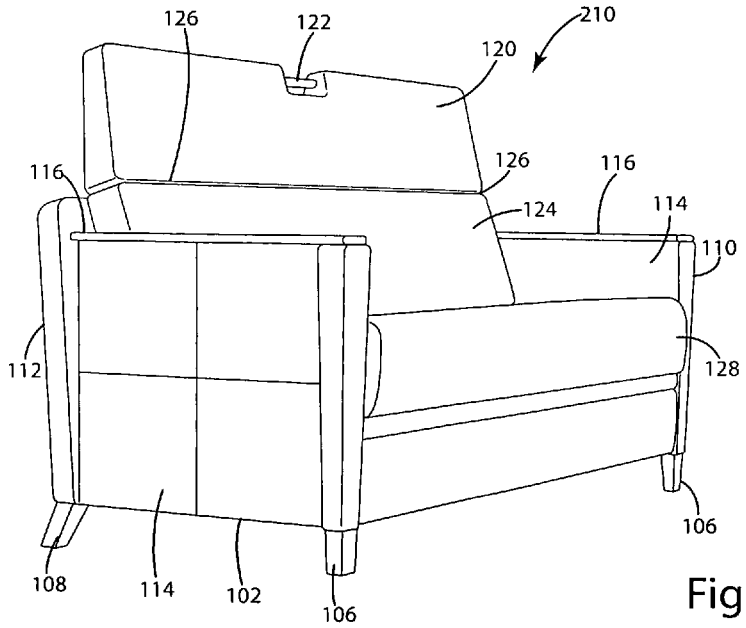
FIG. 18 is a left-side perspective view of the furniture system shown in FIG. 17, but showing the furniture system in a sofa position.
Figure 19:
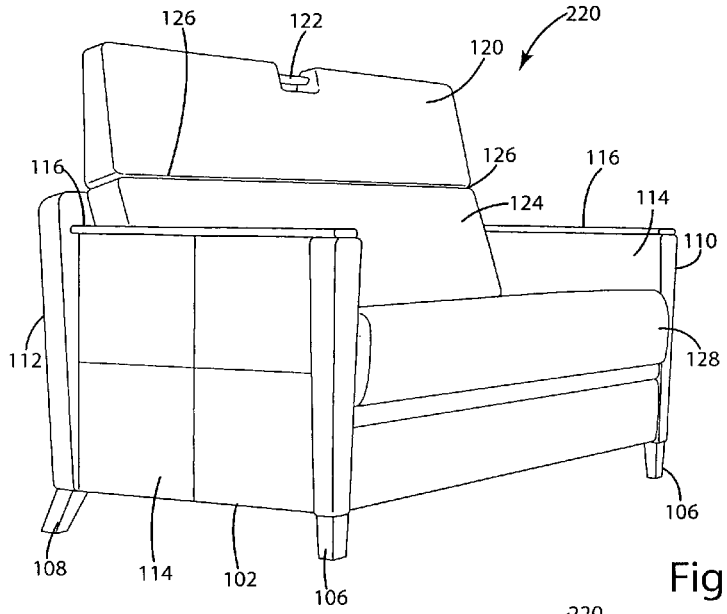
FIG. 19 is a left-side perspective view of a further embodiment of a furniture system in accordance with the invention, with the illustration showing the furniture system in a sofa position and having recessed wood insert/wood cap arms with a continuous upholstered panel.
Figure 20:
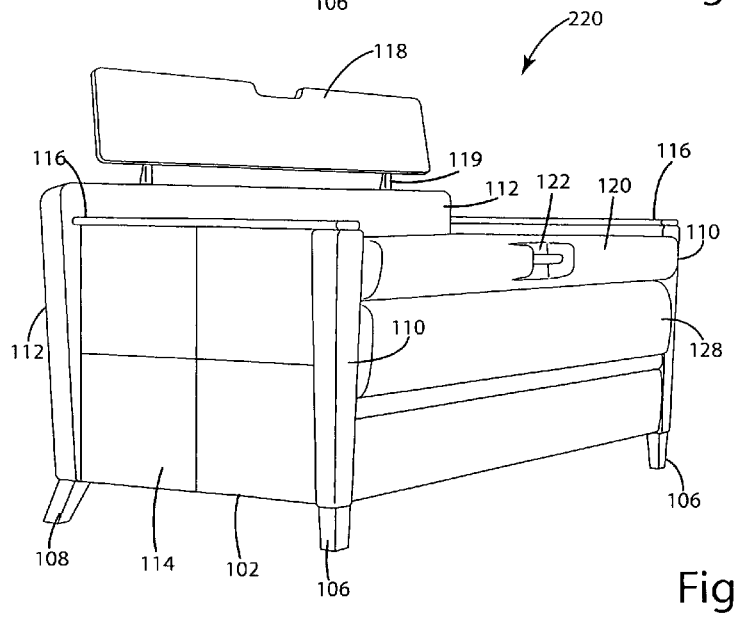
FIG. 20 is a left-side perspective view of the furniture system shown in FIG. 19, but showing the system in a sleep configuration.

The sides 114 and arms 116 of the furniture system 100 shown in FIG. 1 can be characterized as having a recessed configuration with wood cap arms. Correspondingly, FIGS. 15-29 illustrate various other embodiments of furniture systems showing the systems in both sofa and sleep configurations, and also showing various illustrations of the use of the ottomans 130 and drawer 132. For example, FIG. 15 illustrates a furniture system 200 in the sofa configuration. In this configuration, the sides 114 and arms 116 can be characterized as having a recessed configuration with wood cap arms. The system 200 can be characterized as an "open base" system, without ottomans or any drawer. FIG. 16 illustrates the furniture system 200 shown in FIG. 15, but showing the furniture system 200 in the sleep or bed configuration. FIG. 17 illustrates a further embodiment of a furniture system 210. The system 210 is shown in the sleep configuration and includes sides 114 and arms 116 having recessed configurations with wood cap arms. The lower front of the system 210 includes a continuous upholstered panel. The system 210 does not include any ottomans 130 or drawer 132. FIG. 18 illustrates the furniture system 210 shown in FIG. 17, but with the system 210 in the sofa configuration. FIG. 19 identifies a further embodiment of a furniture system characterized as furniture system 220. The furniture system 220 is shown in the sofa configuration in FIG. 19. The system 220 can be characterized as having sides 114 and arms 116 identified as recessed wood inserts with wood cap arms. The system 220 can also be characterized as one having a continuous upholstered panel. FIG. 20 is a further illustration of the system 220 shown in FIG. 19, but showing the system 220 in the sleep or bed configuration.

Figure 21:
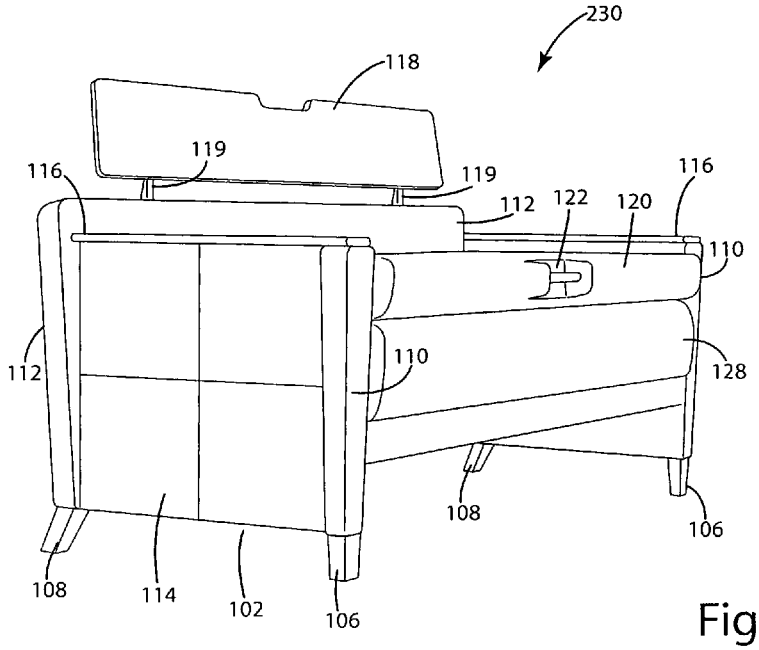
FIG. 21 is a left-side perspective view of a further embodiment of a furniture system in accordance with the invention, with the system shown in a sleep position and having recessed wood panel/wood cap arms with an open base.
Figure 22:
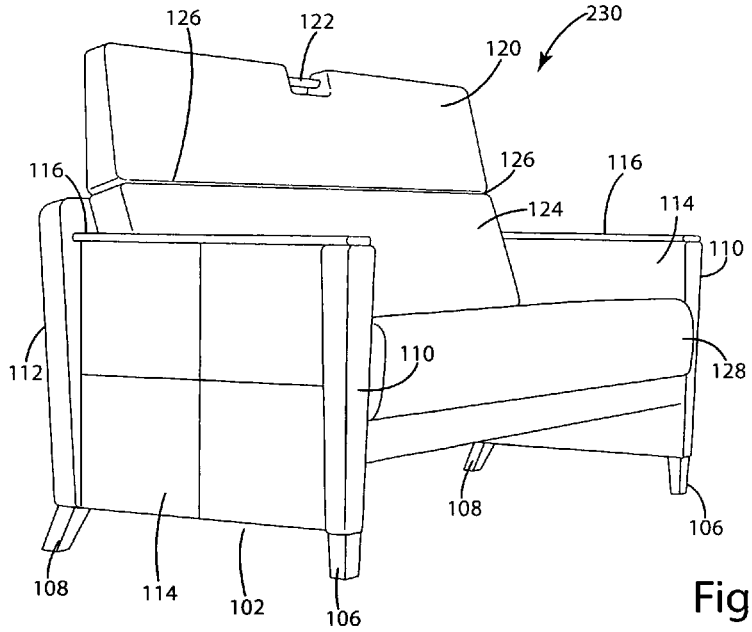
FIG. 22 is a left-side perspective view of a furniture system in accordance with FIG. 21, but showing the system in a sofa configuration.

FIG. 21 illustrates a further embodiment of a furniture system referenced as furniture system 230. The sides 114 and arms 116 of the system 230 can be characterized as having a recessed wood panel configuration, with wood cap arms. The system 230 also includes an open base, without ottomans 130 or a drawer 132. FIG. 22 is a further illustration of the furniture system 230 as shown in FIG. 21, but showing the system 230 in the sofa configuration.

Figure 23:
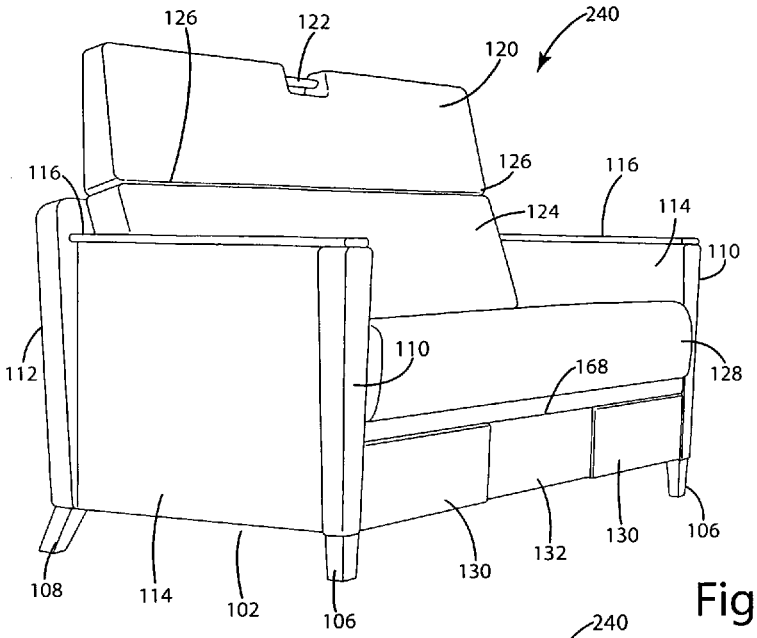
FIG. 23 is a left-side perspective view of a further embodiment of a furniture system in accordance with the invention, illustrating the furniture system in a sofa position and having recessed wood panel/wood cap arms with one or more retracted ottomans and a retracted drawer.
Figure 24:
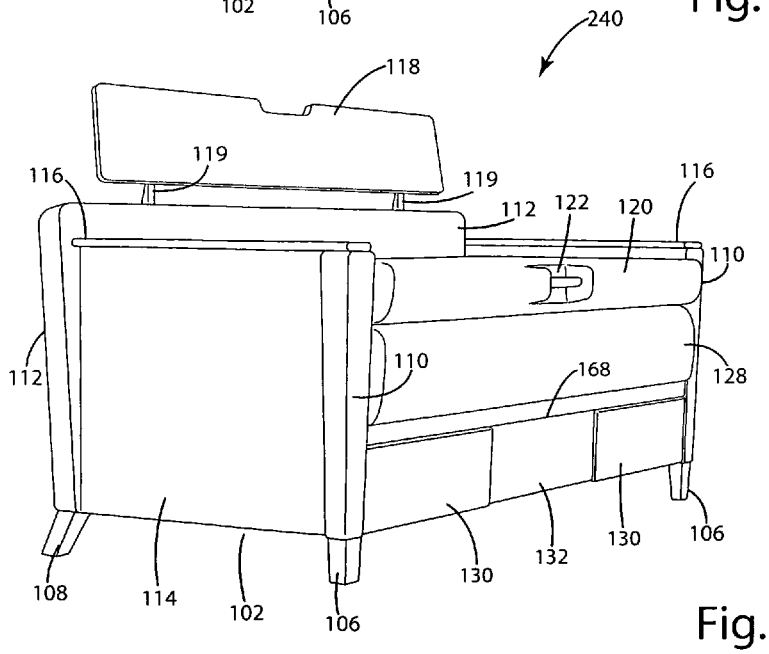
FIG. 24 is a left-side perspective view of the furniture system shown in FIG. 23, but showing the system in a sleep configuration.

FIG. 23 is an illustration somewhat similar to FIG. 1, but showing a furniture system 240. The system 240 includes sides 114 and arms 116 which can be characterized as having a recessed wood panel configuration, with wood cap arms. FIG. 23 also illustrates the ottoman and drawer options, and shows a pair of ottomans 130 and drawer 132 in retracted positions. FIG. 24 also illustrates the furniture system 240, but shows the furniture system 240 in the sleep or bed configuration.

Figure 25:
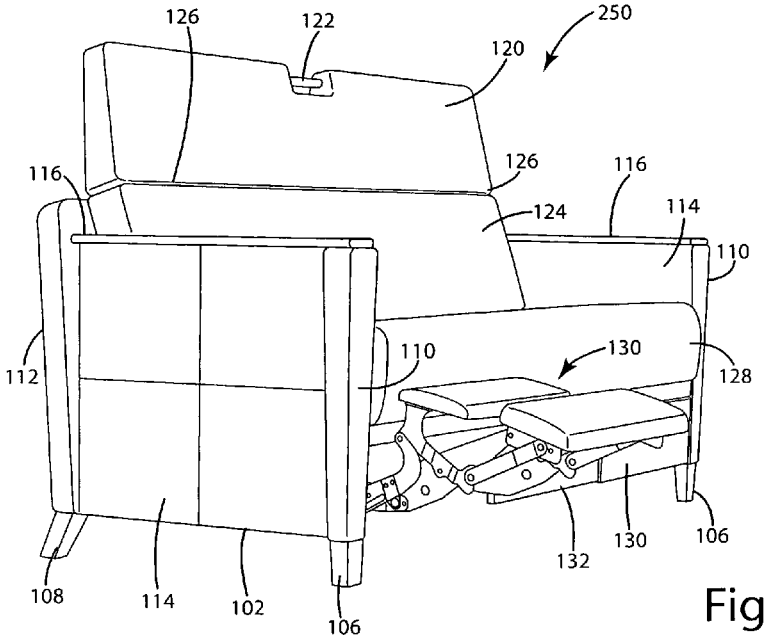
FIG. 25 is a left-side perspective view of a further embodiment of a furniture system, illustrating the system in a sofa configuration and having recessed wood cap arms, with a drawer in a retracted position and an ottoman in an extended position.
Figure 26:
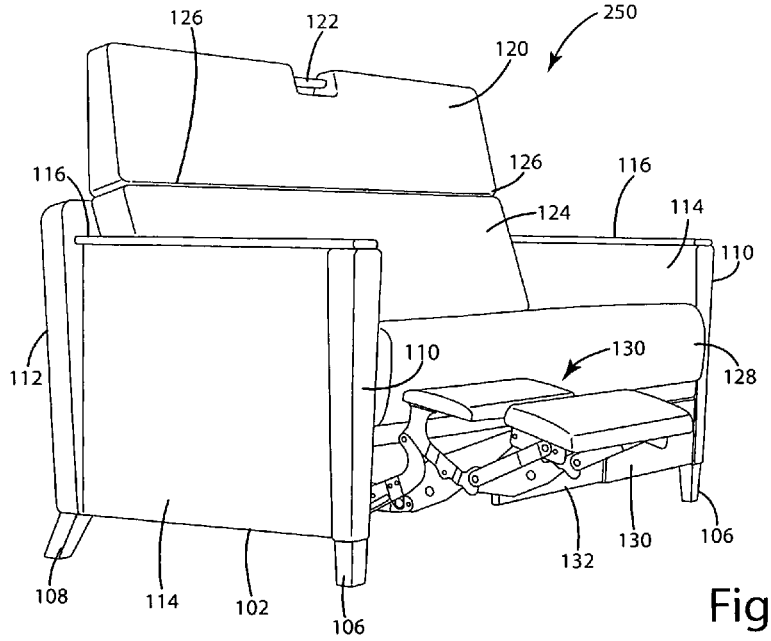
FIG. 26 is a left-side perspective view of the furniture system shown in FIG. 23, but showing an ottoman in an extended position.
Figure 27:
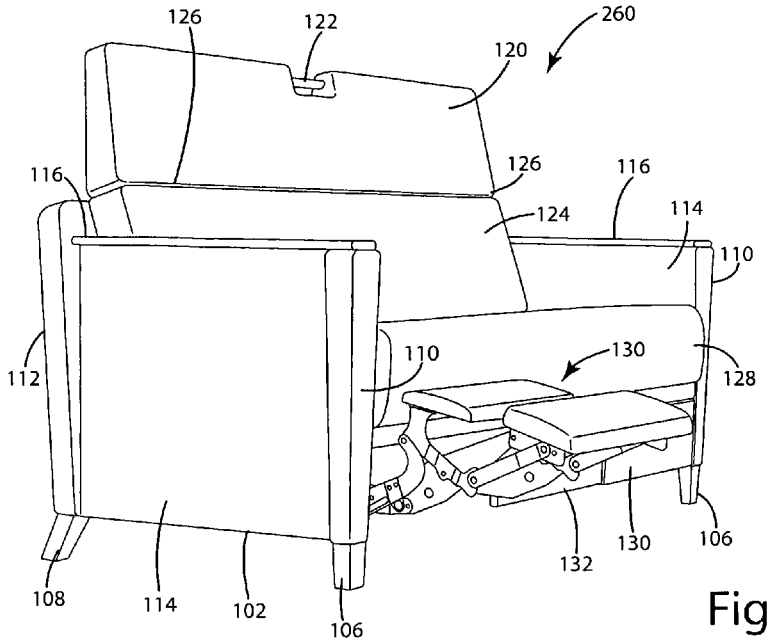
FIG. 27 is a left-side perspective view of a further embodiment of a furniture system, illustrating the furniture system in a sofa configuration and having upholstered arms with a retracted drawer and an extended ottoman.

FIG. 25 is an illustration of furniture system 242, showing a sofa with a recessed wood cap arm, having ottoman and drawer options. The ottoman 130 is shown in an extended position. FIG. 26 illustrates a furniture system 250 similar to the system shown in FIG. 24, with the system having a recessed wood panel with wood cap arms, and ottoman and drawer options with the ottoman 130 in an extended position. The sides 114 and arms 116 can be characterized as having recessed wood panels with wood cap arms. FIG. 27 illustrates a furniture system 260. The system is shown with an extended ottoman 130. The sides 114 and arms 116 of system 260 can be characterized as having upholstered configurations.

Figure 28:
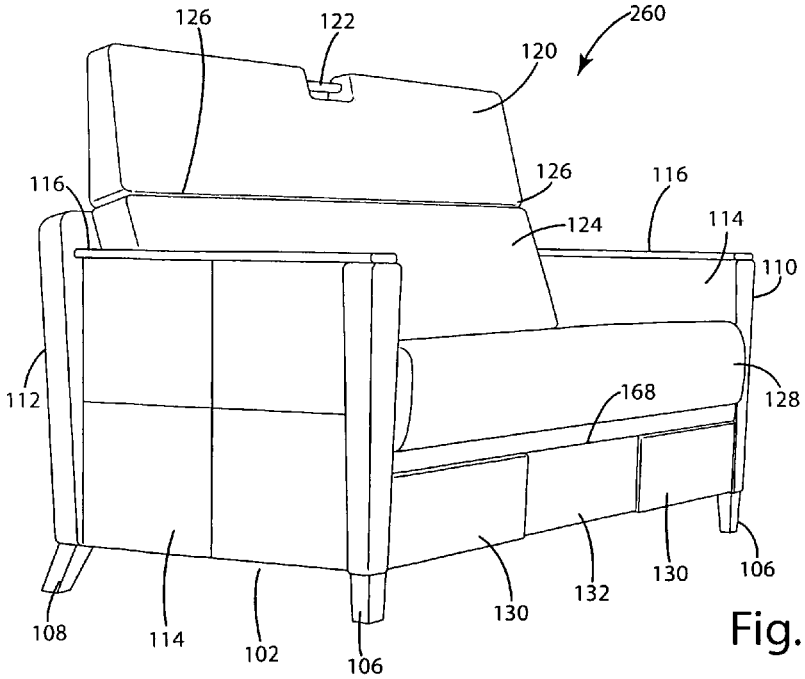
FIG. 28 is a left-side perspective view of the furniture system shown in FIG. 27, but with the ottoman in a retracted position.
Figure 29:
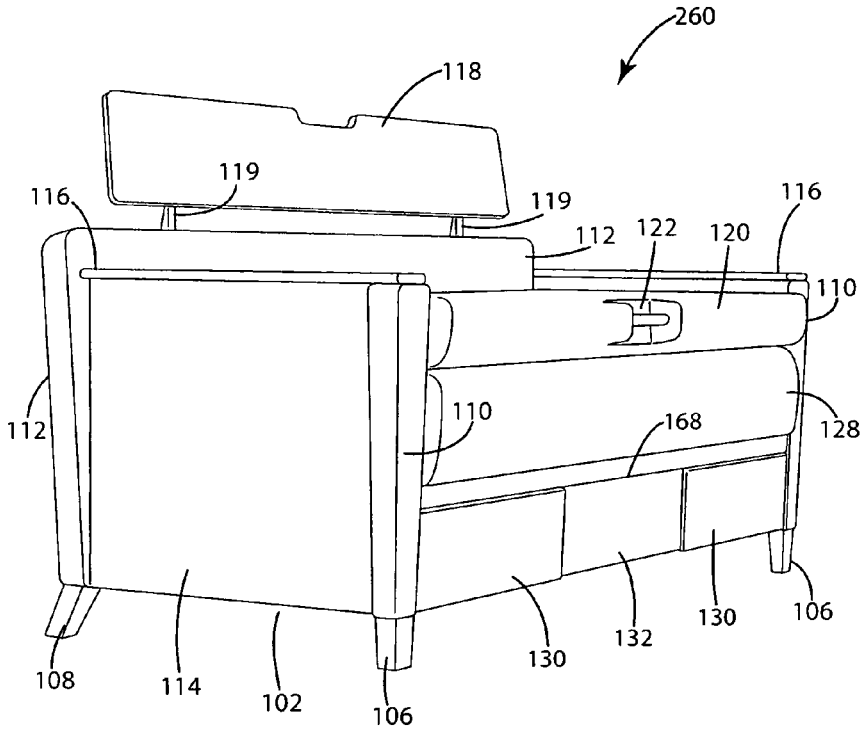
FIG. 29 is a left-side perspective view of the furniture system shown in FIG. 28, but showing the system in a sleep configuration.

FIG. 28 is a further view of the furniture system 260. In contrast to FIG. 27, the furniture system 260 in FIG. 28 is shown with the ottomans 130 in retracted positions. FIG. 29 illustrates the furniture system 260 with the ottomans 130 in a retracted position, and with the system 260 in a sleep or bed configuration.

Figure 30:
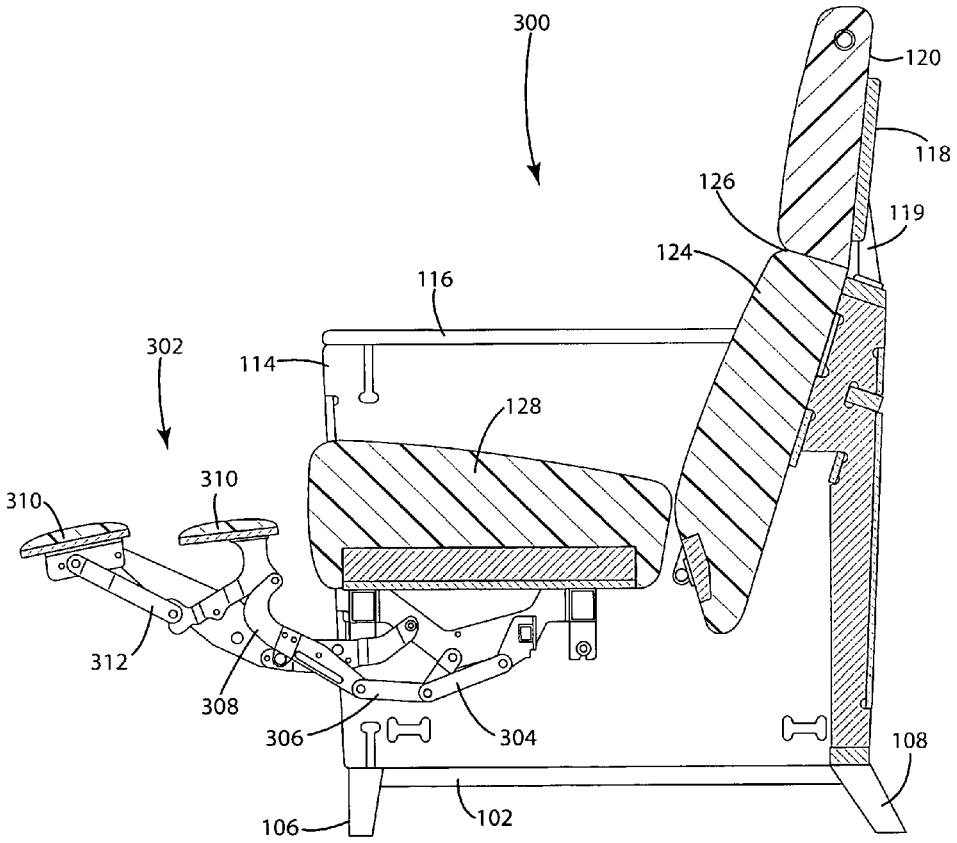
FIG. 30 is a side sectional view of an ottoman connected to a furniture system in accordance with the invention, and showing the ottoman in an extended position.

FIG. 30 illustrates a furniture system 300 in a vertical, sectional view, showing an example interconnection of an ottoman 302 to the furniture system 300, with the furniture system 300 having the convertible sofa/bed conversion mechanisms as previously described herein. It should be noted that FIG. 30 illustrates the ottoman 302 in an extended position. With reference to FIG. 30, the ottoman 302 is connected to appropriate elements of the sofa/bed configuration through a hardware assembly 304. The hardware assembly 304 includes a stationary support frame 306 fixedly secured to other elements of the sofa/bed configuration. It should be further emphasized that FIG. 30 is illustrating only one-half of the configuration of the ottoman 302 with the associated hardware assembly 304. Pivotably secured to a rear portion of the stationary support frame 306 is a pivot bracket 308. The pivot bracket 308, at an end opposing the connection to the stationary support frame 306, is coupled to a pivot link 310. The pivot link 310 is coupled both to the stationary support frame 306 and is associated with a second pivot bracket 312. The second pivot bracket 312 is coupled at one end in a pivotal matter to an external linkage 314. The external linkage 314 includes a first footpad link 316. The first footpad link 316 is coupled to a lower frame section of a first footpad 318. Coupled to the lower frame section of the first footpad 318 is a second footpad linkage 320. The second footpad linkage 320 is, in turn, coupled to the second footpad 322.

In accordance with the foregoing and as shown in FIG. 30, the hardware assembly 304 facilitates extension and retraction of the ottoman 302 in a relatively conventional manner. An ottoman having features associated with extension and retraction from seating furniture is disclosed in Johnson et al., U.S. Pat. No. 5,695,239, issued Dec. 9, 1997.

Figure 31:
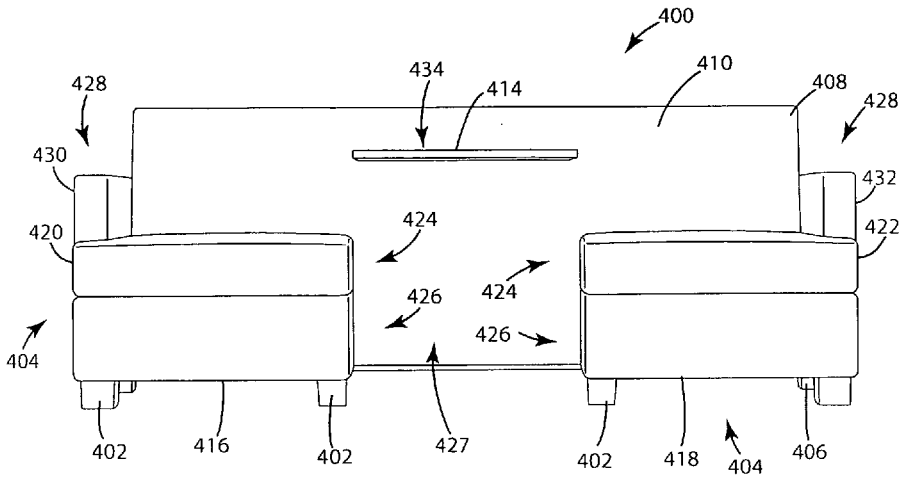
FIG. 31 is a front, elevation view of a furniture system in accordance with the invention, and showing the use of a desk and a sitting or sofa configuration.
Figure 32:
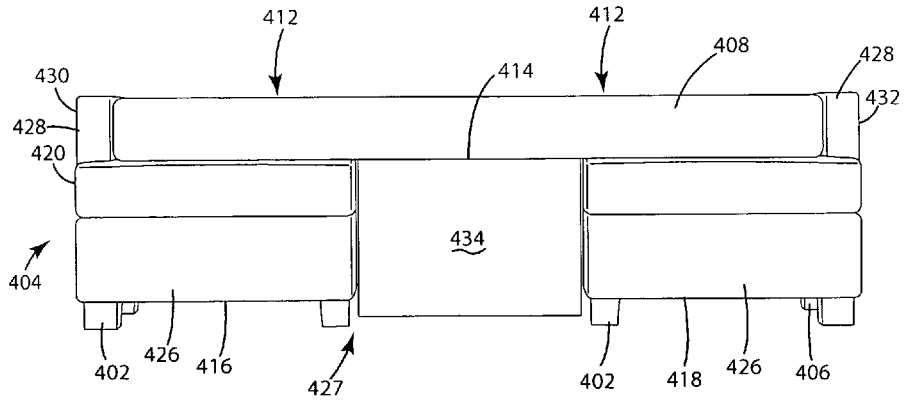
FIG. 32 is a front, elevation view of the furniture system shown in FIG. 31, but showing the system in a sleep configuration.
Figure 33:
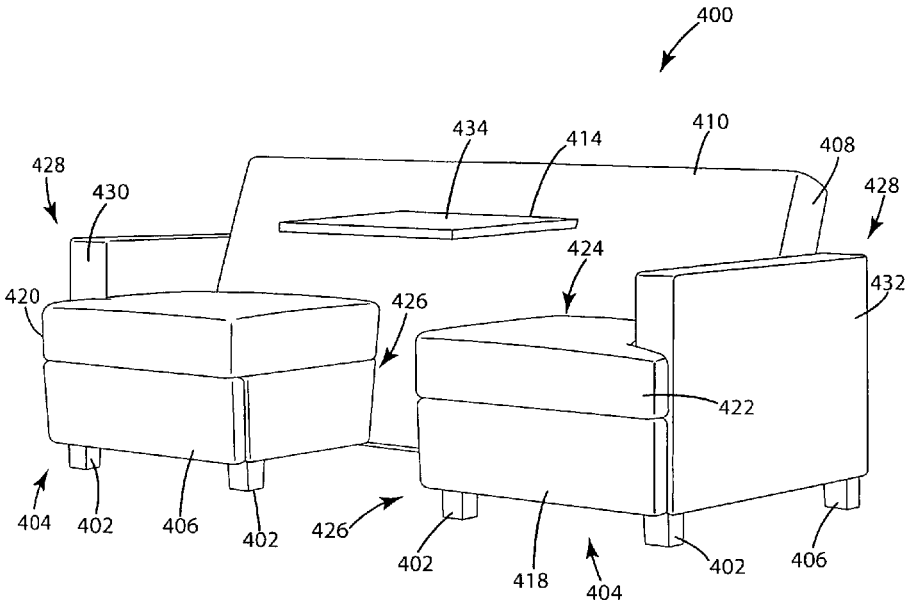
FIG. 33 is a right-side perspective view of the furniture system shown in FIG. 31.
Figure 34:
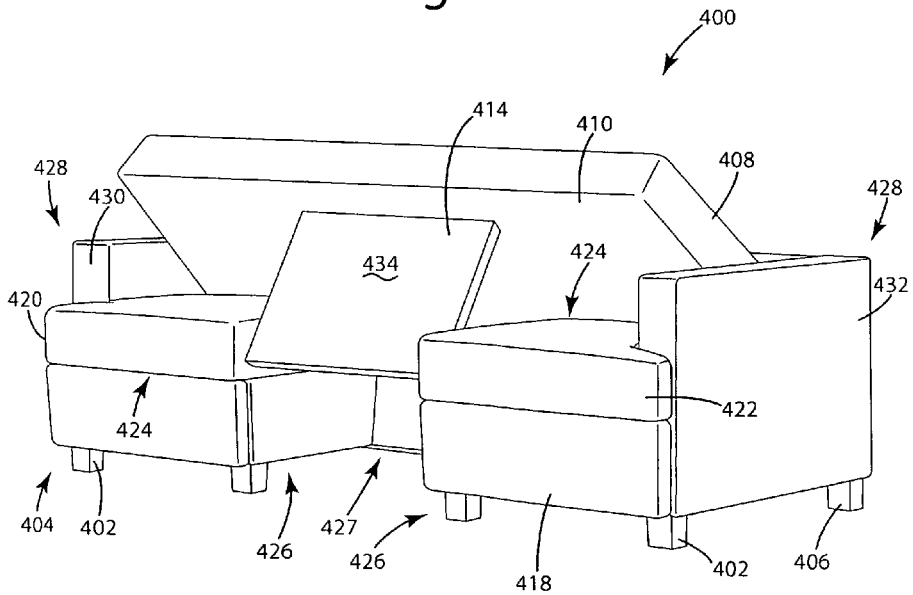
FIG. 34 is a right-side perspective view of the furniture system shown in FIG. 31, but showing the system in a movement substantially half way between a sitting configuration and a sleep configuration.
Figure 35:
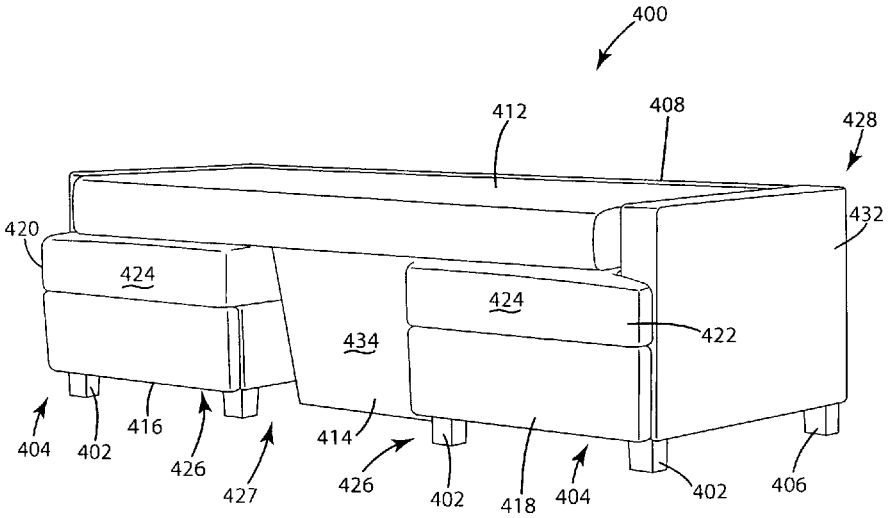
FIG. 35 is a right-side perspective view of the furniture system shown in FIG. 31, with the system in the configuration shown in FIG. 32.

Turning to FIGS. 31-35, FIG. 31 illustrates the furniture system 400 in a front, elevation view. The furniture system 400 in accordance with the invention can include sets of front legs 402, and corresponding rear legs 406 (with rear legs 406 being shown, for example, in FIGS. 33 and 34). The legs 402, 406 support a frame 404 for the entirety of the furniture system 400. The system 400 further includes a furniture back 408, with the furniture back 408 having a back front surface 410 (as shown in FIG. 31) and a rear back surface 412 (as shown in FIG. 32).

Extending forwardly from the upper central portion of the back front surface 410 is a desk 414. The desk 414 includes an upper work surface 434. The desk provides for an integrated work surface for use by individuals using the furniture system 400. The desk is preferably positioned so that it does not extend forwardly beyond the frontal vertical plane of the furniture system 400.

The furniture system 400 also includes a pair of bases 426. The bases 426 include a left-side base 416 and right-side base 418. Positioned above the bases 426 are a pair of seats 424. The seats 424 comprise a left-side seat 420 and right-side seat 422. Advantageously, and in accordance with the invention, it should be noted that with the size and configuration of the bases 426 and seats 424, a spatial interior area 427 exists between the lateral sides of the seats 424 and bases 426 which face each other. With this interior area 427, individuals seated on either of the seats 424 can position their legs forwardly of the front vertical plane of the furniture system 400 or, alternatively, can position themselves in a "sideways" orientation so that their legs extend into the spatial interior area 427. With this configuration, persons seated on either of the seats 424 can advantageously use the desk 414 while they are in extremely comfortable seating positions. It should also be noted at this time that for purposes of proper functional operation of the furniture system 400, it is preferable for the desk 414 to be centered laterally between the seats 424, and also to have a width which is smaller than the width of the spatial interior area 427. These dimensional considerations are advantageous so as to provide for the desk 414 to "fit between" the seats 424 when the furniture system 400 is moved to a sleep configuration.

In addition to the aforedescribed elements, the furniture system 400 can also include a pair of arms 428 positioned on opposing sides of the system 400. The arms 428 can include a left-side arm 430 and right-side arm 432. These arms 428 provide arm rests for individuals seated on the seats 424.

As earlier described, the furniture system in accordance with the invention can move between sitting configurations and sleep configurations. FIG. 31 illustrates the furniture system 400 in a sitting configuration. Correspondingly, FIG. 32 illustrates the furniture system 400 in a sleep configuration. It should be noted that in the sleep configuration, the rear surface 412 of the back 408 acts as the sleep surface for the user. Further, and advantageously in accordance with the invention, the desk 434 conveniently is stored between the seats 424 when the furniture system 400 is in the sleep configuration. Again, it should be noted that when the furniture system 400 is in either the sitting configuration or the sleep configuration, the desk 414 does not extend beyond the footprint of the basic furniture system 400.

For purposes of functional operation, the furniture system 400 (and other embodiments of furniture systems in accordance with the invention as described herein) can include a pair of linkage mechanisms 470. One of the linkage mechanisms 470 is illustrated in FIGS. 49-54. Each of FIGS. 49-54 illustrate the general configuration of one of the linkage mechanisms 470 when the furniture system 400 is moving between the sitting configuration and the sleep configuration. Details of the linkage mechanisms which can be utilized with furniture systems in accordance with the invention have been substantially described with respect to the linkage mechanism 134 associated with the furniture systems illustrated in FIGS. 1-30. Accordingly, a detailed description of the operation of linkage mechanism 470 will not be set forth herein. However, its specific operation will be apparent from the description of the operation of the linkage mechanism 134. Further, it should be emphasized that various types of linkage mechanisms can be utilized in accordance with the invention, other than linkage mechanism 470, without departing from the spirit and scope of the principal novel concepts of the invention.

In general, the linkage mechanism 470 can include a first link 472, as specifically shown in FIGS. 49-54. The first link 472 is substantially elongated and is connected at its end through a connection point 474 to the back 408. The other end of the first link 472 is connected through a link point 476 to the seat 424. This link and connection point 476 is further connected to one end of an extension link 478. The other end of the extension link 478 is connected through a link point 480 to a long link 482. The opposing end of the long link 482 is connected through a link point 484 to a short link 486. The short link 486 is connected to an intermediate link 488 through a connection point 496. The short link 486, while being connected to the long link 482 and link point 484, is connected to or otherwise integral with an intermediate link 488 at a connection point 496. At the opposing end of intermediate link 488, the link is connected to a further link 494 through a link point 492. The opposing end of the further link 494 is secured to the back 408 through the connection point 490.

Figure 49:
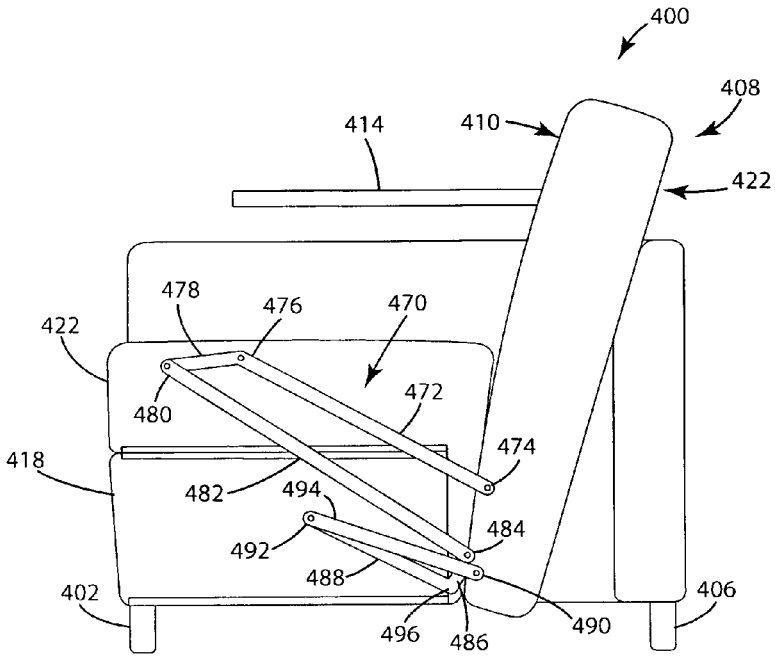
FIG. 49 is a side, elevation view of the furniture system shown in FIG. 1, with one of the linkage mechanisms shown in a cutout configuration and showing the system in a sitting configuration.
Figure 50:
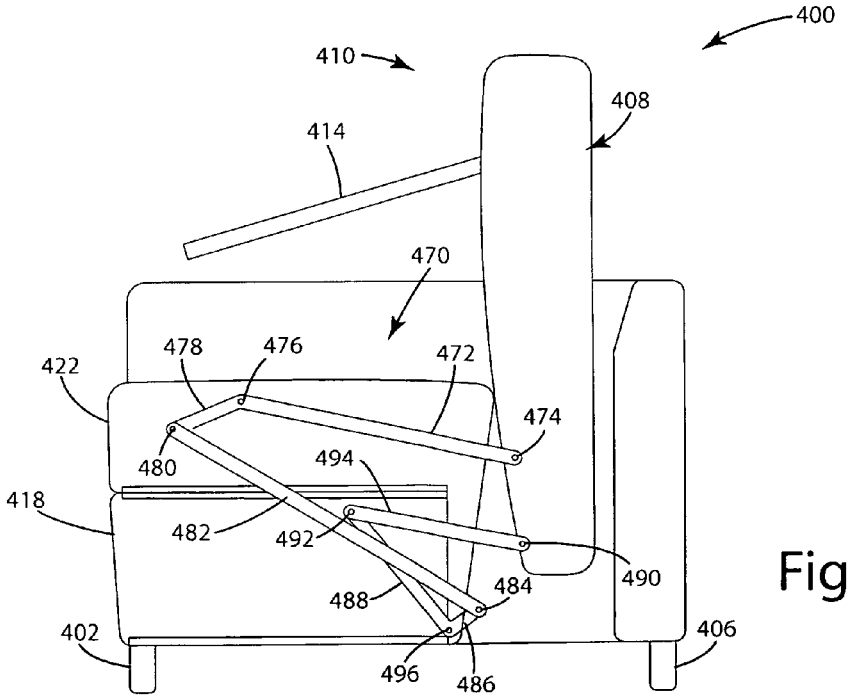
FIG. 50 is a side, elevation view of the furniture system shown in FIG. 49, but showing the system as it initially moves away from the sitting configuration.
Figure 51:
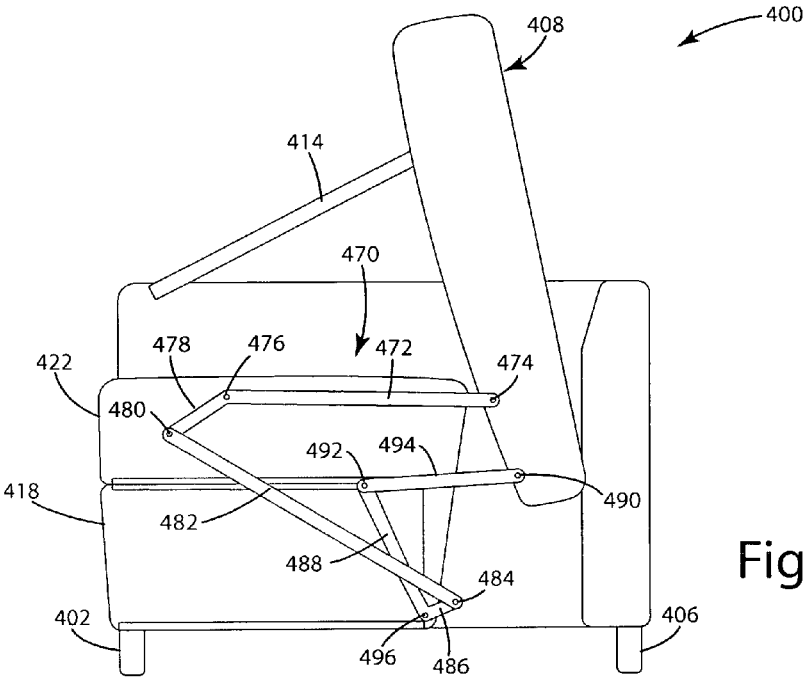
FIG. 51 is a right-side elevation view of the furniture system shown in FIG. 49, and showing still further movement of the system away from the sitting configuration and toward the sleep configuration.
Figure 52:
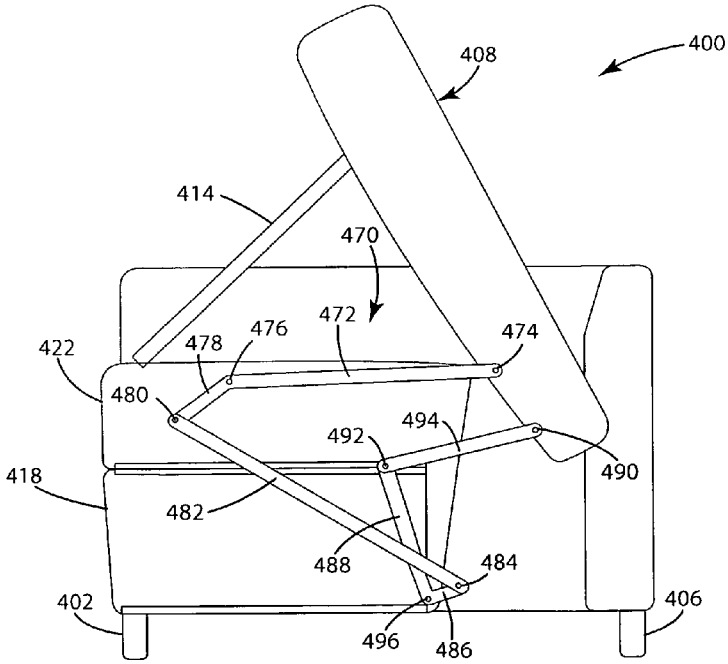
FIG. 52 is a right-side elevation view of the furniture system shown in FIG. 49, but with further movement toward the sleep configuration.
Figure 53:
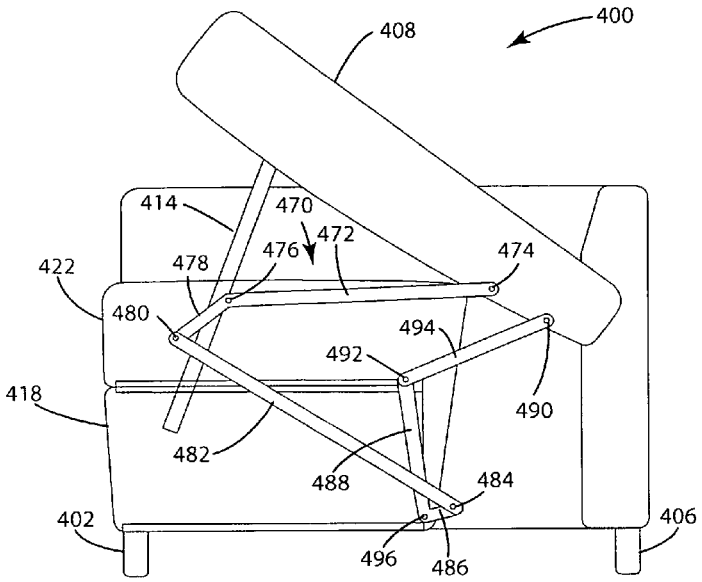
FIG. 53 is another right-side elevation view of the furniture system shown in FIG. 49, as the system nears its position in a sleep configuration.
Figure 54:
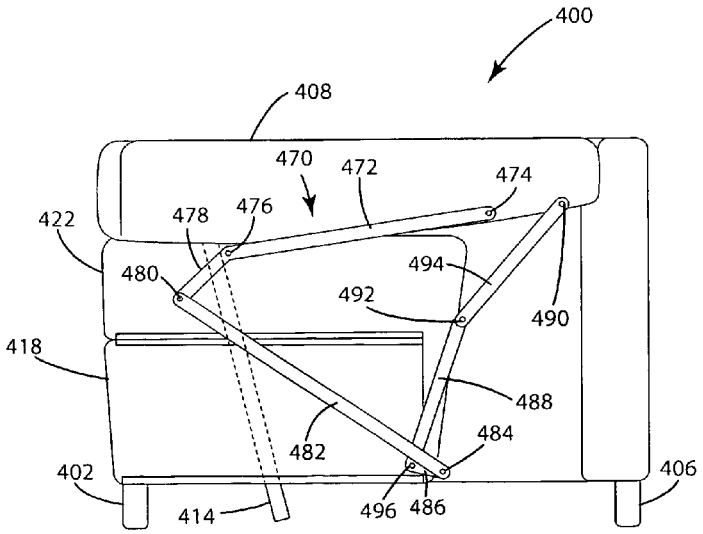
FIG. 54 is a right-side perspective view of the furniture system shown in FIG. 49, with the system in a final sofa, bed or sleep configuration.

It should be noted that although there is a connection of the back 408 to the first link 472 and the further link 494 through connection points 474 and 490, respectively, these connection points 474 and 490 permit the furniture back 408 to rotate relative to the aforedescribed links. In this regard, the configuration of the linkage mechanism 470 when the back 408 is in an upright position and the furniture system 400 is in a full sitting configuration is shown in FIG. 49. FIG. 50 illustrates the orientation of the linkage mechanism 470 as a user would pull forwardly on the back 408, so as to start to move the back 408 away from the sitting configuration. FIG. 51 illustrates a further orientation of linkage mechanism 470 as the back 408 is further pulled forwardly by the user. FIGS. 52 and 53 illustrate further orientations of the linkage mechanism 470 as the back 408 is moved toward the sleep configuration. In this regard, FIG. 54 specifically illustrates the linkage mechanism 470 when the back 408 is fully reclined and the entirety of the furniture system 400 is in the sleep configuration.

Figure 36:
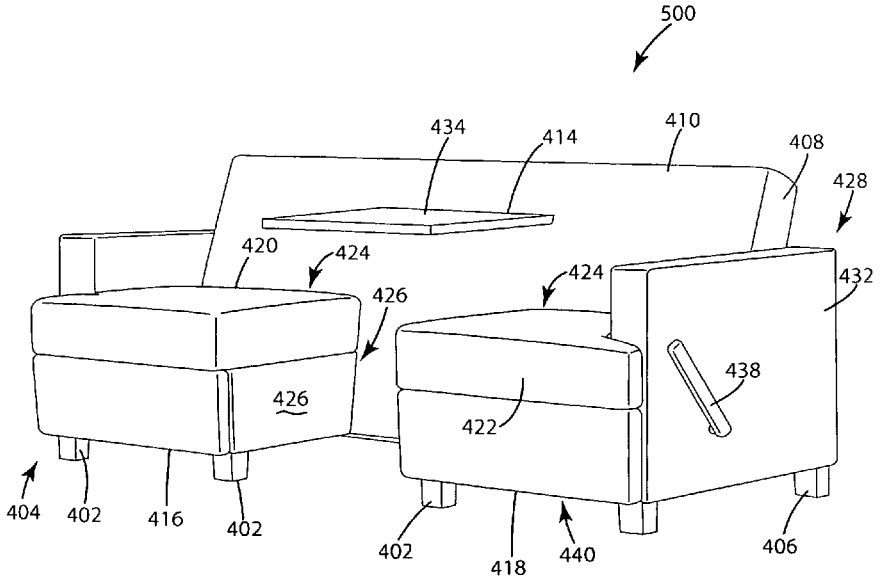
FIG. 36 is a right-side perspective view of a further embodiment of a furniture system in accordance with the invention, with the embodiment showing a lever for purposes of manipulating an integrated footrest or ottoman.
Figure 37:
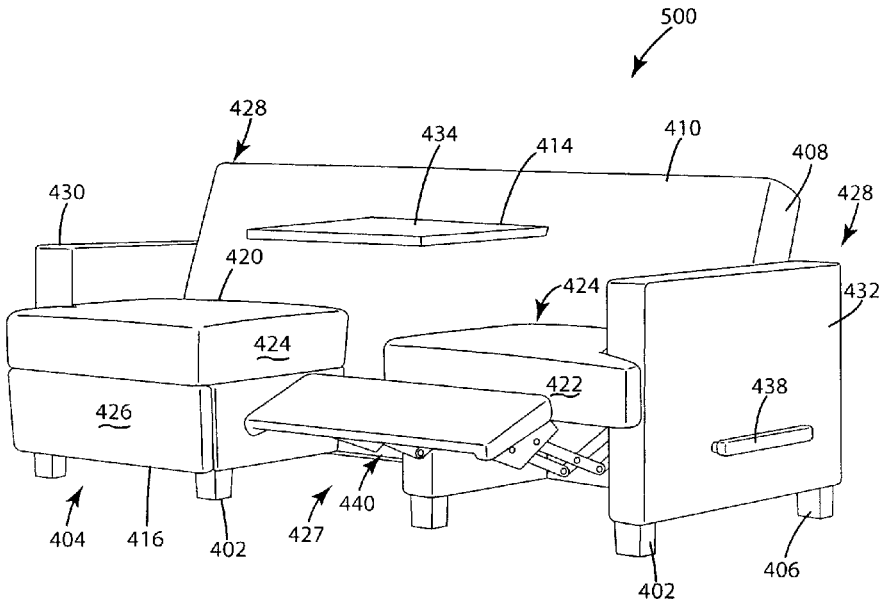
FIG. 37 is a right-side perspective view of the furniture system shown in FIG. 36, but with the system having the ottoman in an extended position.

As previously described, other configurations of furniture systems in accordance with the invention can provide for integrated storage and footrests or ottoman functions. For example, FIGS. 36 and 37 illustrate another embodiment of a furniture system 500 in accordance with the invention. The furniture system 500 includes at least one ottoman or footrest 440 positioned within the right side base 418. The ottoman or footrest 440 cannot actually be seen in FIG. 36, as it is in a retracted position. The ottoman or footrest 440 is operated through the lever arm 438. Details associated with the use of a linkage mechanism for purposes of operating an ottoman through the use of a lever arm at the side of a furniture system were previously shown in FIG. 30 and also previously described herein in the detailed description of FIG. 30. A similar linkage arrangement for operating the ottoman or footrest 440 through the lever arm 438 can be utilized with respect to the furniture system 500. FIG. 36 illustrates the ottoman or footrest 440 in the retracted position, while FIG. 37 illustrates the ottoman or footrest 440 in the extended position.

Figure 38:
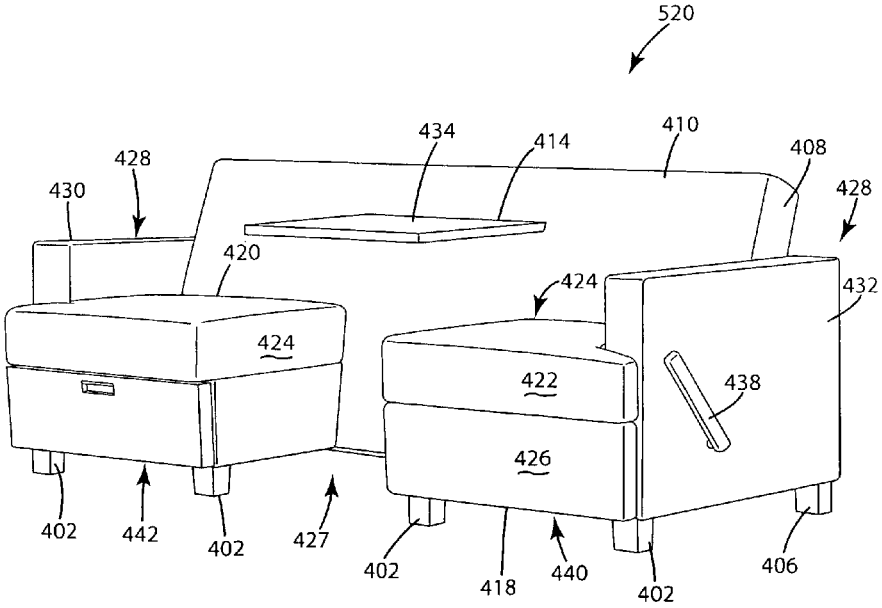
FIG. 38 is a right-side perspective view of a still further embodiment of a furniture system in accordance with the invention, showing a system having an ottoman in a retracted position, and a storage drawer in a closed position.
Figure 39:
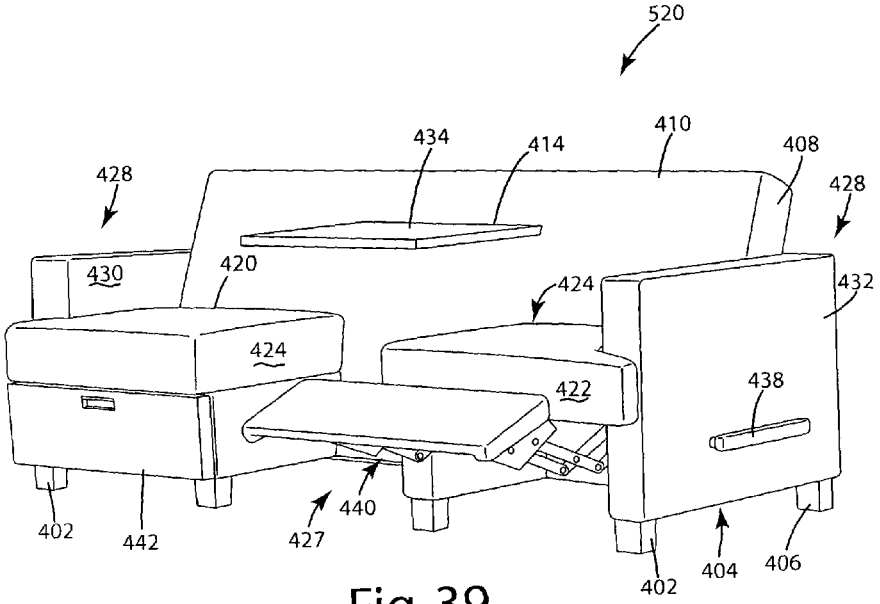
FIG. 39 is a right-side perspective view of the furniture system shown in FIG. 38, but showing the ottoman in an extended position.

FIGS. 38 and 39 illustrate a further embodiment 520 of a furniture system in accordance with the invention. FIG. 38 illustrates an ottoman or footrest 440 in a retracted position, and further illustrates a storage drawer 442 positioned below the seat 420 within the base 416. The storage drawer 442 is shown in the retracted position. FIG. 38 illustrates the ottoman or footrest 440 in the retracted position, while FIG. 39 illustrates the ottoman or footrest 440 in the extended position.

Figure 40:
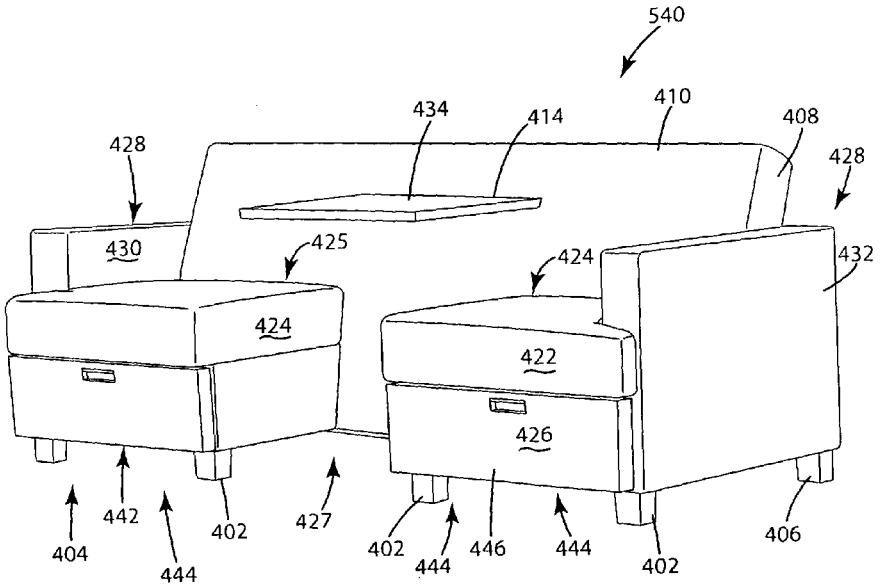
FIG. 40 is a right-side perspective view of a still further embodiment of a furniture system in accordance with the invention, with the system having a pair of storage drawers, shown in retracted positions.
Figure 41:
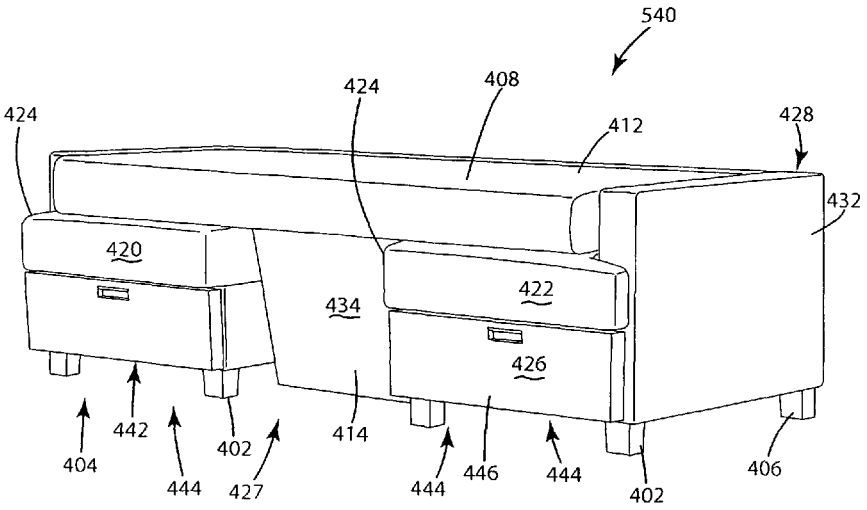
FIG. 41 is a right-side perspective view of the furniture system shown in FIG. 40, but showing the system in a sleep configuration.
Figure 42:
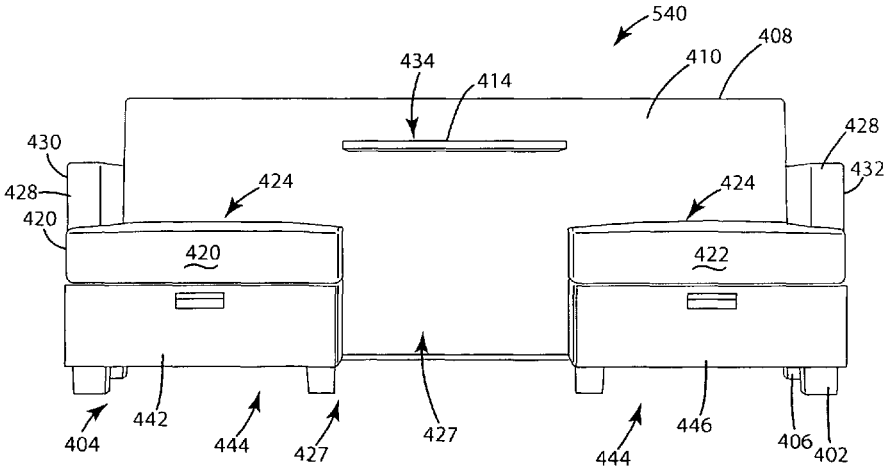
FIG. 42 is a front, elevation view of the sleep system shown in FIG. 40, and showing the system in a sitting configuration.
Figure 43:
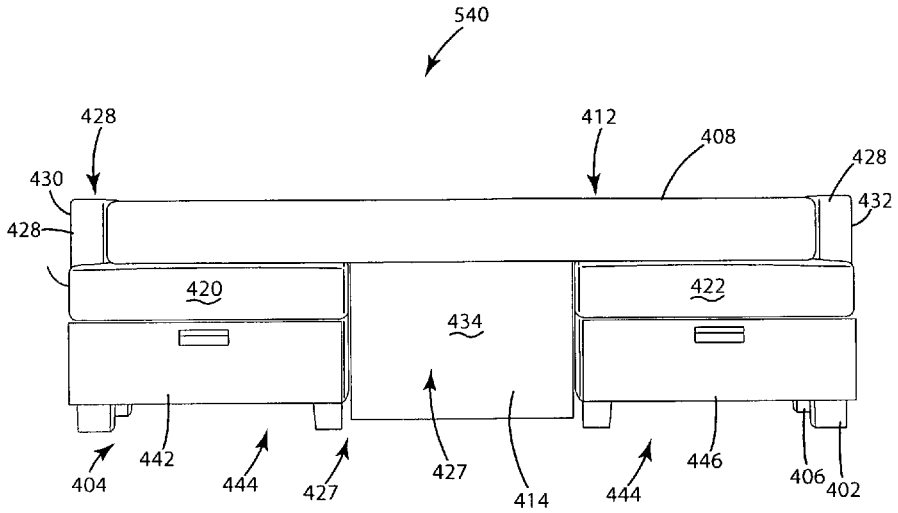
FIG. 43 is a front, elevation view of the furniture system shown in FIG. 40, but showing the system in a sleep configuration as also shown in FIG. 41.
Figure 44:
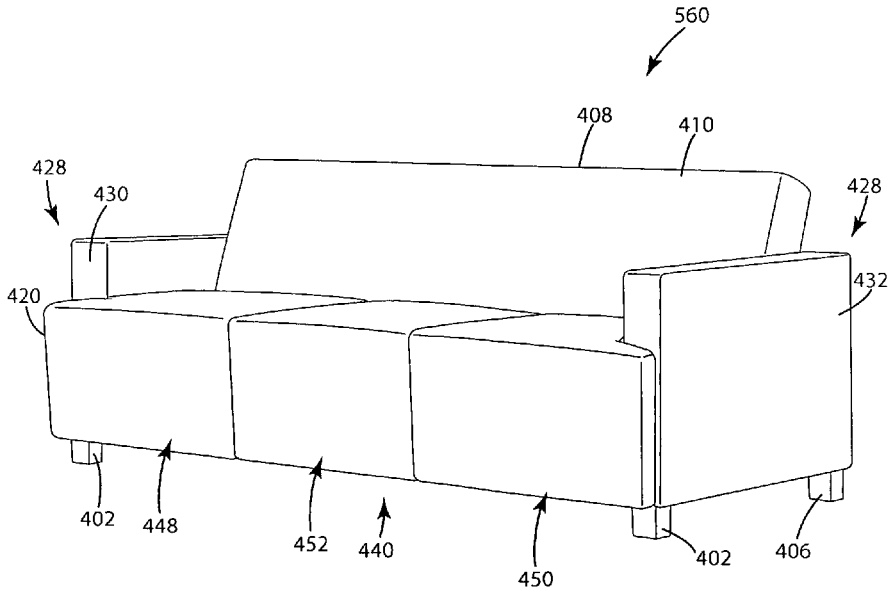
FIG. 44 is a right-side perspective view of yet another embodiment of a furniture system in accordance with the invention, showing the system as having left and right-side bases and seats, along with a center base and seat.

An additional embodiment of the invention is shown as embodiment 540 as illustrated in FIGS. 40-43. The furniture system 540 does not include an ottoman or footrest, but instead includes a pair of storage drawers 444, identified as left-side storage drawer 442 and right-side storage drawer 446. FIGS. 40 and 42 illustrate the furniture system 540 in a sitting configuration, while FIGS. 41 and 43 illustrate the furniture system 540 in a sleep configuration.

Figure 45:
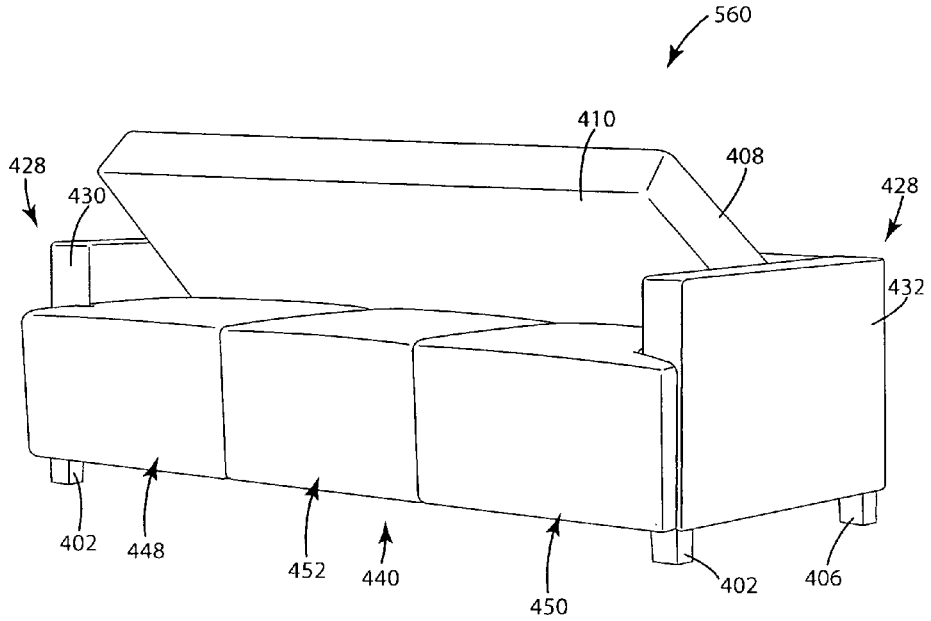
FIG. 45 is a right-side perspective view of the furniture system shown in FIG. 44, but showing the system in an orientation which is substantially half way between a sitting configuration and a sleep configuration.
Figure 46:
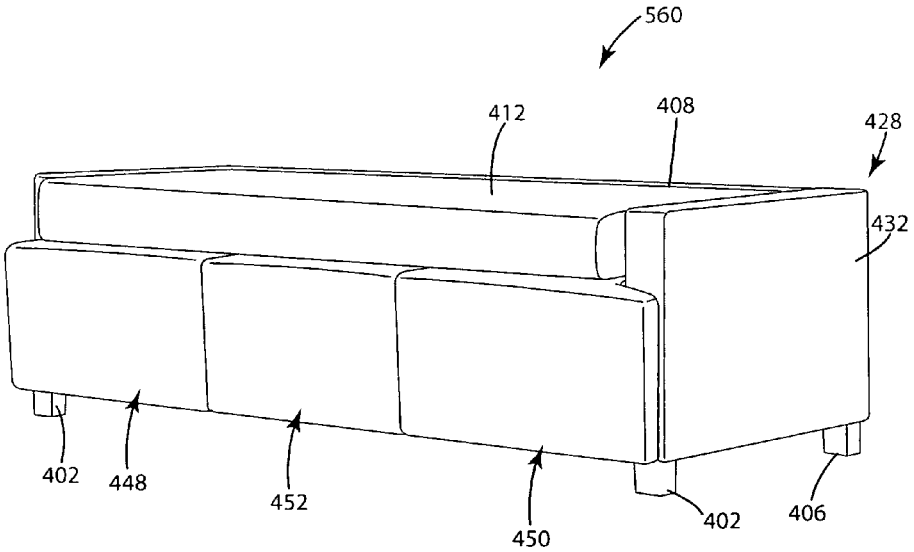
FIG. 46 is a right-side perspective view of the furniture system shown in FIG. 44, but showing the system in a sleep configuration.
Figure 47:
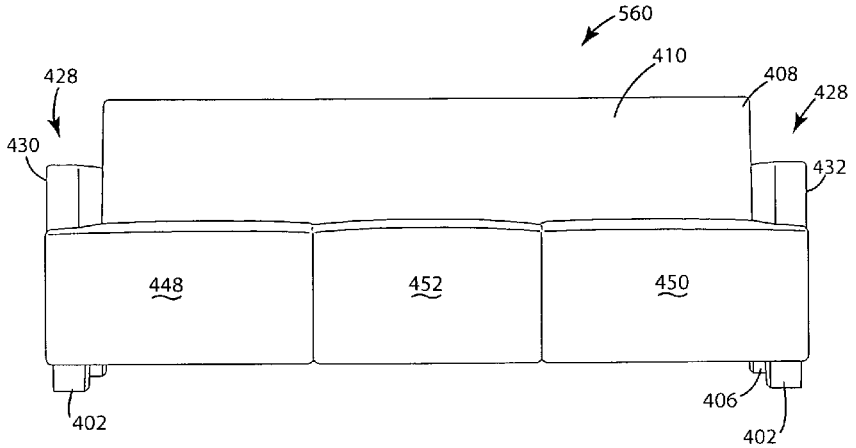
FIG. 47 is a front, elevation view of the furniture system shown in FIG. 44, and showing the system in a sitting configuration.
Figure 48:
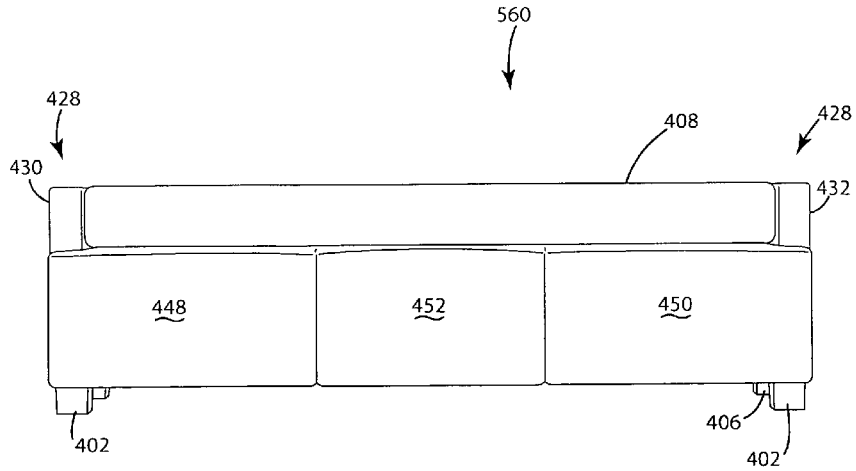
FIG. 48 is a front, elevation view of the furniture system shown in FIG. 44, and showing the system in a sleep configuration.

A still further embodiment of a furniture system in accordance with the invention is illustrated in FIGS. 44-48. The furniture system 560 is illustrated in a sitting configuration in FIGS. 44 and 47. FIGS. 46 and 48 illustrate the furniture system in a sleep configuration. FIG. 45 illustrates the furniture system 560 as it is being moved between a sitting configuration and sleep configuration. The particular embodiment 560 of a furniture system in accordance with the invention does not include any ottoman or footrest, or any storage drawers. However, the furniture system 560 includes a left-side base and seat configuration 448, and a right-side base and seat configuration 450. Still further, and in accordance with the invention, the furniture system 560 includes a center base and seat configuration 452. The center base and seat configuration 452 is positioned in the center of the furniture system 560, intermediate the right and left-side base and seat configurations 446, 448, respectively.

In accordance with the foregoing, extremely comfortable and versatile seating arrangements have been provided as furniture systems in accordance with the invention, with certain of the furniture systems combining and adding the needs of desking and sleeping into a single space-efficient furniture unit. In this manner, a virtual "family room" can be provided inside, for example, a hospital patient room. This furniture system provides versatility, while continuing to maintain a small, compact footprint that does not encroach upon any "working space" of the hospital room. That is, hospital staff can move effortlessly about, even while in emergency situations, with the family and friends warmly and comfortably embraced within the furniture system. It is this novel combination of functionality which forms the basis of a number of the concepts of the invention. Such functionality includes the integration of seating, work surface/desking and sleep configurations. Also, certain furniture systems in accordance with invention include integrated footrests or ottomans, as well as integrated storage. Conversion between a sitting configuration and a sleep configuration is provided within the furniture system's own footprint. Still further, the sleep surface provided by the back front surface 410 is separate from the sitting surface provided by the seats 424. Also, the conversion mechanisms, such as the linkage mechanism 470, are concealed within the arms 428. Still further, and as previously described, the seats 424 provide for alternative seating positions, including a forward position and a sideways position. In addition, the desk or work surface essentially converts to a working position, without moving out of the footprint of the furniture systems.

It will be apparent to those skilled in the pertinent arts that other embodiments of furniture systems in accordance with the invention, including sleep systems with various combinations, can be designed. That is, the principles of furniture systems in accordance with the invention are not limited to the specific embodiments described herein. Accordingly, it will be apparent those skilled in the art that modifications and other variations of the above-described illustrative embodiments of the invention may be effected without departing from the spirit and scope of the novel concepts of the invention.

The invention claimed is:

1. A sleep system assembly adapted for conversion between various environmental applications, said environmental applications comprising at least a sitting configuration, a sleeping configuration, and a desking configuration, said sleep system assembly comprising:

a supporting frame;

at least a pair of seats, each having an upper surface on which a user may sit when said sleep system assembly is in said sitting configuration;

a furniture back positioned substantially upwardly and rearwardly from said seats, and adapted to provide back support when a user is sitting in one of said seats and said sleep system assembly is in said sitting configuration, said furniture back comprising a back front surface and a rear back surface;

at least one linkage mechanism, said linkage mechanism being directly or indirectly connected to said frame, and adapted to move said sleep system assembly between said sitting configuration and others of said environmental applications;

a desk coupled to said back front surface of said furniture back, and positioned forwardly and extending in a horizontal plane when said sleep system assembly is in said sitting configuration;

a foot print of said sleep system assembly is maintained as a pre-determined size independent of the particular environmental application of said sleep system assembly at any given time;

when said sleep system assembly is in said sleeping configuration, said rear back surface acts as a sleeping surface for said user; and said desk can be converted between an operable position and a non-operable position without the necessity of moving outside of said foot print of said predetermined size of said sleep system assembly when in either of said positions.

2. A sleep system assembly in accordance with claim 1, characterized in that a back support is provided within said sofa configuration.

3. A sleep system assembly in accordance with claim 1, characterized in that said linkage mechanism is hidden from view at all times during operation or stationary position of said sleep system assembly.

4. A sleep system assembly in accordance with claim 1, characterized in that said assembly is specifically adaptable between said sleeping configuration and a desking application.

5. A sleep system assembly in accordance with claim 1, characterized in that said assembly is convertible between said sleep configuration and said sitting configuration, and is further convertible between said sitting configuration and a desking application.

6. A sleep system assembly in accordance with claim 1, characterized in that said desk is coupled to a back front surface.

7. A sleep system assembly in accordance with claim 1, characterized in that said desk moves in unison with a back front surface when said sleep system assembly is moving between configurations.

8. A sleep system assembly in accordance with claim 1, characterized in that in each of said various environmental applications, said desk is positioned so as to not extend forwardly beyond a front vertical plane of the entirety of said sleep system assembly.

9. A sleep system assembly in accordance with claim 1, characterized in that said desk is capable of being stored between opposing seats of said assembly when said assembly is in said sleep configuration.

10. A sleep system assembly in accordance with claim 9, characterized in that when said sleep system assembly is in said sleep configuration, said desk is fitted between said opposing seats of said assembly.

11. A sleep system assembly in accordance with claim 10, characterized in that when said assembly is in said sitting configuration, said assembly comprises pairs of bases and seats, configured so as to provide a spatial interior area between lateral sides of said seats and bases, with said seats and bases facing each other.

12. A sleep system assembly in accordance with claim 11, characterized in that when said assembly is in said sitting configuration, and users are seated on said seats, said users can position their legs forwardly of a front vertical plane of said sleep system assembly or, alternatively, can position their legs in a sideways orientation, with their legs extending into said interior spatial area.

13. A sleep system assembly in accordance with claim 1, characterized in that said assembly comprises at least one integrated footrest, said footrest being movable between an extended position and a hidden, retracted position.

14. A sleep system assembly in accordance with claim 1, characterized in that said assembly comprises at least one integrated storage area.

15. A sleep system assembly in accordance with claim 1, characterized in that said assembly comprises at least one integrated footrest, and lever means for manipulating said integrated footrest.

16. A sleep system assembly in accordance with claim 11, characterized in that said desk is centered laterally between seats of said assembly, and has a width which is smaller than the width of said spatial interior area.

17. A sleep system assembly adapted for conversion between various environmental applications, said environmental applications comprising at least a sitting configuration, a sleeping configuration, and a desking configuration, said sleep system assembly comprising:

a supporting frame;

at least a pair of seats, each having an upper surface on which a user may sit when said sleep system assembly is in a sofa sitting configuration;

a furniture back positioned substantially upwardly and rearwardly from said seats, and adapted to provide back support when a user is sitting in one of said seats and said sleep system assembly is in said sofa sitting configuration, said furniture back comprising a back front surface and a rear back surface;

at least one linkage mechanism, said linkage mechanism being directly or indirectly connected to said frame, and adapted to move said sleep system assembly between said sofa sitting configuration and others of said environmental applications;

a desk coupled to said back front surface of said furniture back, and positioned forwardly and extending in a horizontal plane when said sleep system assembly is in said sitting configuration;

a foot print of said sleep system assembly is maintained as a pre-determined size independent of the particular environmental application of said sleep system assembly at any given time;

when said sleep system assembly is in said sleeping configuration, said rear back surface acts as a sleeping surface for said user; and in each of said environmental applications, said desk is positioned so as to not extend forwardly beyond a front vertical plane of the entirety of said sleep system assembly.

18. A sleep system assembly in accordance with claim 17, characterized in that a back support is provided within said sofa configuration.

19. A sleep system assembly in accordance with claim 17, characterized in that said linkage mechanism is hidden from view at all times during operation or stationary position of said sleep system assembly.

20. A sleep system assembly in accordance with claim 17, characterized in that said assembly is specifically adaptable between said sleeping configuration and a desking application.

21. A sleep system assembly in accordance with claim 17, characterized in that said assembly is convertible between said sleep configuration and said sitting configuration, and is further convertible between said sitting configuration and a desking application.

22. A sleep system assembly in accordance with claim 17, characterized in that said desk is coupled to a back front surface.

23. A sleep system assembly in accordance with claim 17, characterized in that said desk moves in unison with a back front surface when said sleep system assembly is moving between configurations.

24. A sleep system assembly in accordance with claim 17, characterized in that said desk can be converted between an operable position and a non-operable position without the necessity of moving outside of said foot print of said predetermined size of a foot print of the sleep system assembly when in either of said positions.

25. A sleep system assembly in accordance with claim 17, characterized in that said desk is capable of being stored between opposing seats of said assembly when said assembly is in said sleep configuration.

26. A sleep system assembly in accordance with claim 25, characterized in that when said sleep system assembly is in said sleep configuration, said desk is fitted between said opposing seats of said assembly.

27. A sleep system assembly in accordance with claim 26, characterized in that when said assembly is in said sitting configuration, said assembly comprises pairs of bases and seats, configured so as to provide a spatial interior area between lateral sides of said seats and bases, with said seats and bases facing each other.

28. A sleep system assembly in accordance with claim 27, characterized in that when said assembly is in said sitting configuration, and users are seated on said seats, said users can position their legs forwardly of a front vertical plane of said sleep system assembly or, alternatively, can position their legs in a sideways orientation, with their legs extending into said interior spatial area.

29. A sleep system assembly in accordance with claim 17, characterized in that said assembly comprises at least one integrated footrest, said footrest being movable between an extended position and a hidden, retracted position.

30. A sleep system assembly in accordance with claim 17, characterized in that said assembly comprises at least one integrated storage area.

31. A sleep system assembly in accordance with claim 17, characterized in that said assembly comprises at least one integrated footrest, and lever means for manipulating said integrated footrest.

32. A sleep system assembly in accordance with claim 27, characterized in that said desk is centered laterally between seats of said assembly, and has a width which is smaller than the width of said spatial interior area.

* * * * *